US007119749B2

(12) United States Patent
Miyata et al.

(10) Patent No.: US 7,119,749 B2
(45) Date of Patent: Oct. 10, 2006

(54) ANTENNA AND RADIO COMMUNICATION APPARATUS

(75) Inventors: Akira Miyata, Yokohama (JP); Kazunari Kawahata, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/086,179

(22) Filed: Mar. 22, 2005

(65) Prior Publication Data

US 2005/0243001 A1 Nov. 3, 2005

(30) Foreign Application Priority Data

Apr. 28, 2004 (JP) ..... 2004-134904

(51) Int. Cl.
*H01Q 1/24* (2006.01)

(52) U.S. Cl. ..... 343/702

(58) Field of Classification Search ..... 343/700 MS, 343/702, 750, 751, 752
See application file for complete search history.

(56) References Cited

U.S. PATENT DOCUMENTS 5,969,688 A * 10/1999 Ireland ..... 343/749
6,037,907 A * 3/2000 Ha et al. ..... 343/752
6,873,294 B1 * 3/2005 Anderson et al. ..... 343/702
6,876,329 B1 * 4/2005 Milosavljevic ..... 343/700 MS
6,950,065 B1 * 9/2005 Ying et al. ..... 343/700 MS

FOREIGN PATENT DOCUMENTS

| | | |
|---|---|---|
| JP | 10-173425 | 6/1998 |
| JP | 11-312919 | 11/1999 |
| JP | 2002-076750 | 3/2002 |
| JP | 2002-158529 | 5/2002 |

* cited by examiner

*Primary Examiner*—Shih-Chao Chen
*Assistant Examiner*—Minh Dieu A
(74) *Attorney, Agent, or Firm*—Keating & Bennett LLP

(57) ABSTRACT

An antenna includes a parallel resonant circuit disposed in a non-ground region. The parallel resonant circuit includes a parallel radiation electrode pattern that is patterned in the non-ground region and a surface mount antenna component. The parallel radiation electrode pattern is connected in parallel to the surface mount antenna component. The parallel radiation electrode pattern is arranged in a loop so as to occupy the majority of the non-ground region and defines an inductor of the parallel resonant circuit. A pair of electrodes of the surface mount antenna component defines a capacitor having a capacitance corresponding to a distance between the pair of electrodes.

12 Claims, 24 Drawing Sheets

ANTENNA AND RADIO COMMUNICATION APPARATUS

BACKGROUND OF THE INVENTION

1. Field of the Invention

The present invention relates to antennas used for mobile communication apparatuses and to radio communication apparatuses including the antennas.

2. Description of the Related Art

In terms of miniaturization, frequency adjustment can be easily achieved, and surface mount antennas are often used for mobile communication apparatuses. In such surface mount antennas, a radiation electrode is provided on a surface of a dielectric substrate to define an inductor, and an open end of the radiation electrode is spaced from a feed electrode so as to define a capacitor. Thus, an LC resonant circuit is provided. High-frequency signals are supplied to the radiation electrode via the feed electrode, thus enabling high-frequency radio transmission.

In accordance with a reduction in the size and an increase in the mounting density of mobile communication apparatuses, in particular, such as cellular telephones, in recent years, more compact surface mount antennas with improved antenna efficiency and a wider bandwidth have been suggested, for example, in Japanese Unexamined Patent Application Publication Nos. 10-173425 and 11-312919.

In addition, recently, in accordance with not only the reduction in the size of antennas but also an increase in the number of functions of cellular telephones, antennas capable of multiband transmission and reception have become available, as described in Japanese Unexamined Patent Application Publication Nos. 2002-158529 and 2002-76750.

In other words, in the antenna described in Japanese Unexamined Patent Application Publication No. 2002-158529, as shown in FIG. 23, a radiation electrode 101 is arranged in a loop on a dielectric substrate 100, and an open end 101*a* of the radiation electrode 101 faces a feed electrode 102 with a predetermined distance therebetween. Thus, a capacitor is formed between the open end 101*a* and the feed electrode 102. Changing the capacitance of the capacitor enables multiband performance using a basic mode and a higher mode of the radiation electrode 101, increases the bandwidth, and miniaturizes the antenna.

In the antenna described in Japanese Unexamined Patent Application Publication No. 2002-76750, as shown in FIG. 24, a lumped-constant LC parallel resonant circuit 111 is connected in series to a feeding side of an antenna conductor 110. The antenna conductor 110 is adjusted to resonate at a frequency that is slightly less than a center frequency of an upper frequency band of two frequency bands for transmission and reception. The LC parallel resonant circuit 111 is adjusted to resonate at approximately the center frequency of a lower frequency band for transmission and reception and to provide the antenna conductor 110 with a capacitance to cause the antenna conductor 110 to resonate at the center frequency of the upper frequency band.

However, the known antennas have the following problems.

If the size of the multiband antenna described in Japanese Unexamined Patent Application Publication No. 2002-158529 is microminiaturized to equal to or less than about 1/10 wavelength, the loop diameter of the radiation electrode 101 is reduced. Thus, the capacitance of the capacitor formed by the open end 101*a* and the feed electrode 102 is increased, and an unwanted capacitance occurs between the loop portion of the radiation electrode 101 and the open end 101*a*. This causes a reduction in the transmission and reception bandwidth of the antenna and a reduction in the antenna efficiency. Thus, in practice, it is difficult to microminiaturize the antenna. Even if the size of the antenna is maintained large enough not to reduce the bandwidth and not to reduce the antenna efficiency, there is not enough space to add a lumped-constant element, such as an inductor, to the antenna in order to improve the performance of the antenna. Thus, there is very little flexibility in designing the antenna to improve the performance. This problem also occurs in the antennas described in Japanese Unexamined Patent Application Publication Nos. 10-173425 and 11-312919.

In contrast, according to the multiband antenna described in Japanese Unexamined Patent Application Publication No. 2002-76750, since the LC parallel resonant circuit 111 includes only lumped-constant elements, the loop diameter of the LC parallel resonant circuit 111 is substantially zero. Thus, the LC parallel resonant circuit 111 does not contribute to radiation of electromagnetic waves, and the antenna efficiency is significantly reduced as compared to a situation where an LC parallel resonant circuit is defined by a distributed constant system.

SUMMARY OF THE INVENTION

To overcome the problems described above, preferred embodiments of the present invention provide an antenna and a radio communication apparatus that are capable of performing multi-band transmission and reception in which the size is reduced without reducing the antenna efficiency and in which each bandwidth is increased.

According to a preferred embodiment of the present invention, an antenna includes a mount board having a non-ground region, a parallel resonant circuit provided in the non-ground region, the parallel resonant circuit including a surface mount antenna component including a substrate and at least a pair of electrodes arranged on a surface of the substrate so as to face each other with a predetermined distance therebetween to define a capacitor and a parallel radiation electrode pattern having an inductor and a feed electrode, the parallel radiation electrode pattern being connected in parallel to the capacitor, and a first lumped-constant inductor connected to or included in the parallel resonant circuit.

With this unique structure, the surface mount antenna component is installed in the small non-ground region, and the parallel radiation electrode pattern is also installed in the non-ground region. Thus, even if the size of the entire antenna is reduced, the size of the parallel resonant circuit is maintained relatively large as compared to where a surface mount antenna including the majority of the circuit is installed in a non-ground region. As a result, an unwanted capacitance does not substantially occur, and a margin large enough for adjusting the distance between the at least pair of electrodes provided on the front surface of the substrate is provided. The distance between the pair of electrodes can be freely adjusted to change the capacitance of the capacitor. Thus, the resonant frequency in each mode can be adjusted to a predetermined value. In addition, since the size of the surface mount antenna component is reduced, the length of the parallel radiation electrode pattern defining the inductor is increased, that is, a large inductance can be provided in the parallel resonant circuit, and the resonant frequencies in both the basic mode and the higher mode are significantly reduced. Furthermore, disposing the first inductor between the feed electrode of the parallel resonant circuit and the feed unit enables the first inductor to be used as a matching circuit for the parallel resonant circuit and a feed unit to be connected to the antenna. In addition, disposing the first inductor in the parallel radiation electrode pattern causes the inductance of the parallel resonant circuit to be increased. In addition, the radiation resistance can be increased due to the long parallel radiation electrode pattern. Thus, the radiation efficiency of the antenna is improved, and the bandwidth in each mode is increased.

The first lumped-constant inductor may be disposed between the feed electrode of the parallel resonant circuit and the feed unit.

With this structure, the first lumped-constant inductor contributes to increase the inductance of the parallel resonant circuit, in addition to functioning as a matching circuit for the parallel resonant circuit and the feed unit.

The antenna may further include a second lumped-constant inductor disposed in the parallel radiation electrode pattern.

With this structure, the second lumped-constant inductor increases the inductance of the parallel resonant circuit.

Accordingly, reducing the length of the parallel radiation electrode pattern in accordance with an increased inductance due to the second lumped-constant inductor enables the size of the antenna to be further reduced. In addition, in accordance with the increase in the inductance due to the second lumped-constant inductor, a lower frequency band can be achieved in both the basic mode and the higher mode.

The antenna may further include a second lumped-constant inductor disposed near a connection portion of the surface mount antenna component and the parallel radiation electrode pattern.

With this structure, the parallel radiation electrode pattern and a series circuit including the second lumped-constant inductor and the capacitor are connected in parallel to each other and define the parallel resonant circuit.

The antenna may further include a second lumped-constant inductor disposed in the parallel radiation electrode pattern, and a third lumped-constant inductor disposed near a connection portion of the surface mount antenna component and the parallel radiation electrode pattern.

With this structure, the parallel radiation electrode pattern and a series circuit including the third lumped-constant inductor and the capacitor are connected in parallel to each other and define the parallel resonant circuit. In addition, the second lumped-constant inductor increases the inductance of the parallel resonant circuit.

The first lumped-constant inductor may be disposed in the parallel radiation electrode pattern.

With this structure, the first lumped-constant inductor increases the inductance of the parallel resonant circuit.

The first lumped-constant inductor may be disposed near a connection portion of the surface mount antenna component and the parallel radiation electrode pattern.

With this structure, the parallel radiation electrode pattern and a series circuit including the first lumped-constant inductor and the capacitor are connected in parallel to each other and define the parallel resonant circuit.

The antenna may further include a second lumped-constant inductor disposed near a connection portion of the surface mount antenna component and the parallel radiation electrode pattern. The first lumped-constant inductor may be disposed in the parallel radiation electrode pattern.

With this structure, the parallel radiation electrode pattern including the first lumped-constant inductor and a series circuit including the second lumped-constant inductor and the capacitor are connected in parallel to each other and define the parallel resonant circuit. In addition, the first lumped-constant inductor increases the inductance of the parallel resonant circuit.

The parallel resonant circuits described above may further include an auxiliary radiation electrode pattern that branches and extends from an end electrode, a portion of the parallel radiation electrode pattern that is remote from the feed electrode.

With this structure, the radiation resistance is increased due to the auxiliary radiation electrode pattern, and the antenna efficiency is further improved.

Accordingly, the radiation resistance of the whole antenna increases, and the antenna efficiency increases by the increase in the radiation resistance. Thus, this structure is suitable when the space provided over the non-ground region is small.

The parallel resonant circuit may further include an electrode plate substantially parallel to the mount board, the electrode plate being electrically connected above an end electrode, a portion of the parallel radiation electrode pattern that is remote from the feed electrode.

With this structure, the radiation resistance is increased due to the electrode plate, and the antenna efficiency is further improved.

Accordingly, the radiation resistance of the whole antenna increases, and the antenna efficiency increases as a result of the increase in the radiation resistance. Thus, this structure is suitable when the non-ground region is small.

The parallel radiation electrode pattern may be provided in a non-ground region on a lower side surface of the mount board. The parallel radiation electrode pattern may be connected in parallel to the surface mount antenna component via a through hole.

With this structure, the surface mount antenna component on the upper surface of the mount board and the parallel radiation electrode pattern on the lower surface of the mount board define the parallel resonant circuit. Thus, the area occupied by the parallel resonant circuit is reduced.

Accordingly, the size of the antenna is further reduced.

As described above, the size of the antenna is reduced. In addition, in accordance with an increase in the radiation resistance due to the parallel radiation electrode pattern, the radiation efficiency of the antenna is improved and the bandwidth in each mode is increased. Furthermore, by adjusting the capacitance of the capacitor of the surface mount antenna component and/or by adjusting the inductance in accordance with the length of the parallel radiation electrode pattern, the resonant frequencies in both the basic mode and the higher mode can be freely adjusted. Thus, a superior multiband antenna is achieved.

According to another preferred embodiment of the present invention, a radio communication apparatus includes the antenna according to preferred embodiments of the present invention described above.

Accordingly, a compact radio communication apparatus capable of multiband communication in a wide band with an improved antenna efficiency is provided.

Other features, elements, steps, characteristics and advantages of the present invention will become more apparent from the following detailed description of preferred embodiments with reference to the attached drawings.

DESCRIPTION OF THE PREFERRED EMBODIMENTS

Preferred embodiments of the present invention will be described with reference to the drawings.

First Preferred Embodiment

Figure 1:
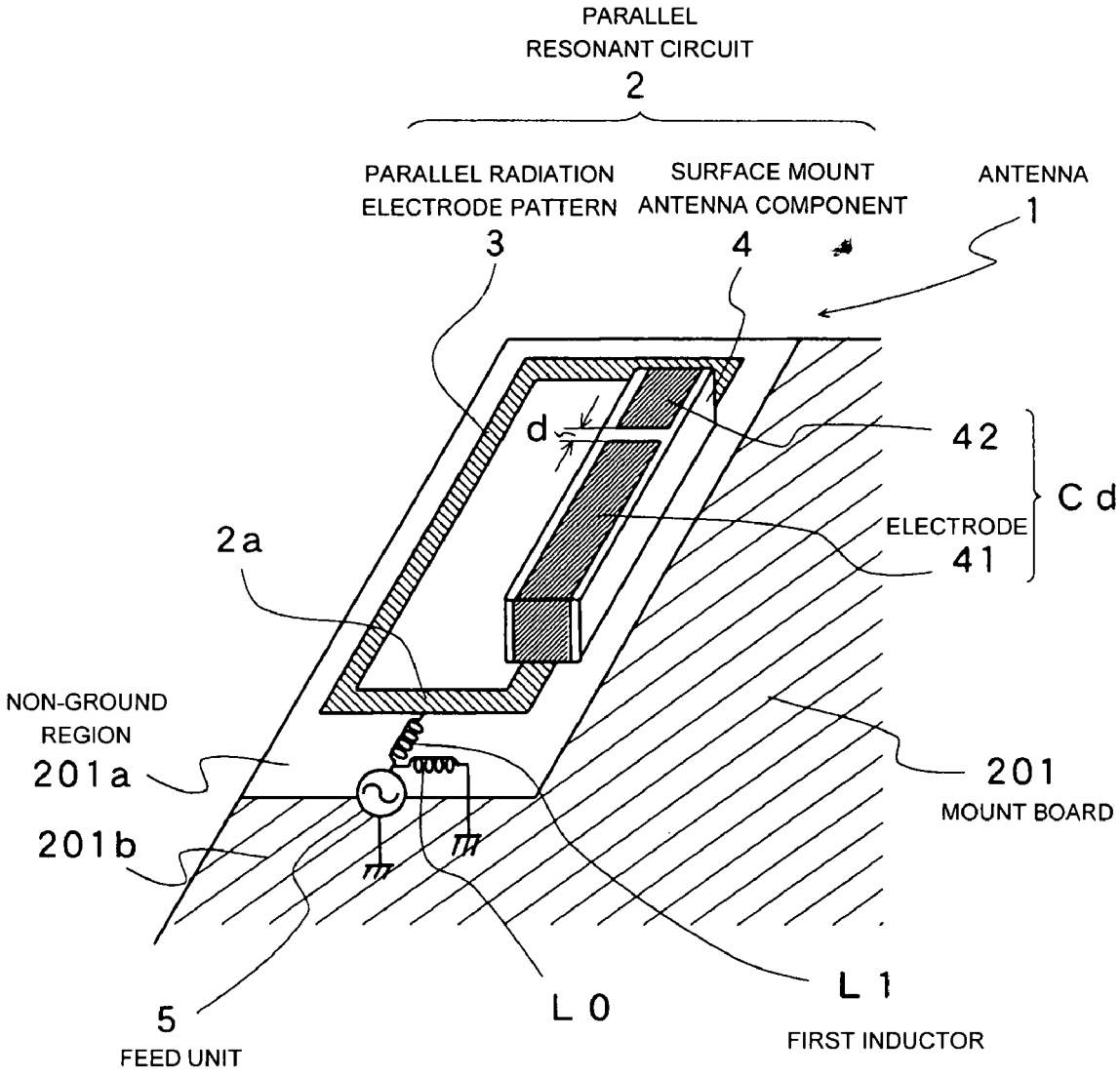
FIG. 1 is a perspective view of an antenna according to a first preferred embodiment of the present invention.
Figure 2:
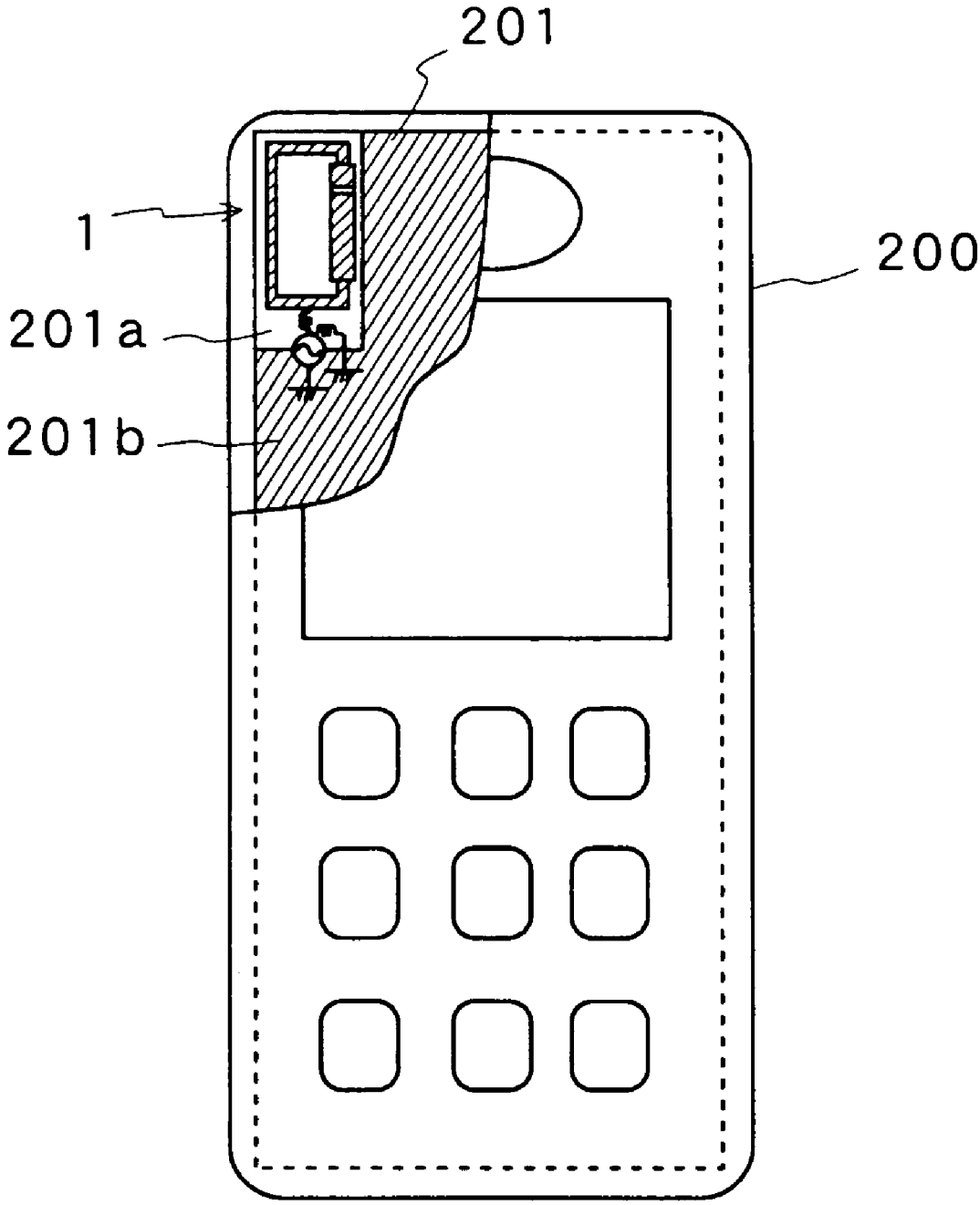
FIG. 2 is a schematic front view of the antenna according to the first preferred embodiment installed in a radio communication apparatus.

FIG. 1 is a perspective view of an antenna according to a first preferred embodiment of the present invention. FIG. 2 is a schematic front view of the antenna according to the first preferred embodiment installed in a radio communication apparatus.

As shown in FIG. 2, an antenna 1 according to the first preferred embodiment is installed in a radio communication apparatus, such as a cellular telephone. In other words, the antenna 1 is installed in a non-ground region 201*a* (a region where a ground electrode 201*b* is not provided) arranged in an upper corner of a mount board 201 of a radio communication apparatus 200. Since the structure of the radio communication apparatus 200 except for the antenna 1 is known, the description thereof is omitted.

As shown in FIG. 1, the antenna 1 includes a parallel resonant circuit 2 provided in the non-ground region 201*a*, and a high-frequency current is supplied from a feed unit 5 to the parallel resonant circuit 2.

The parallel resonant circuit 2 includes a parallel radiation electrode pattern 3 patterned in the non-ground region 201*a* and a surface mount antenna component 4. The parallel radiation electrode pattern 3 and the surface mount antenna component 4 are connected in parallel to each other.

The parallel radiation electrode pattern 3 is arranged in a loop so as to occupy the majority of the non-ground region 201*a* and is open at a bottom of the surface mount antenna component 4. Thus, the parallel radiation electrode pattern 3 of the parallel resonant circuit 2 defines an inductor L. The inductance can be adjusted in accordance with the length of the parallel radiation electrode pattern 3.

The surface mount antenna component 4 is connected on the parallel radiation electrode pattern 3 arranged as described above.

Figure 3:
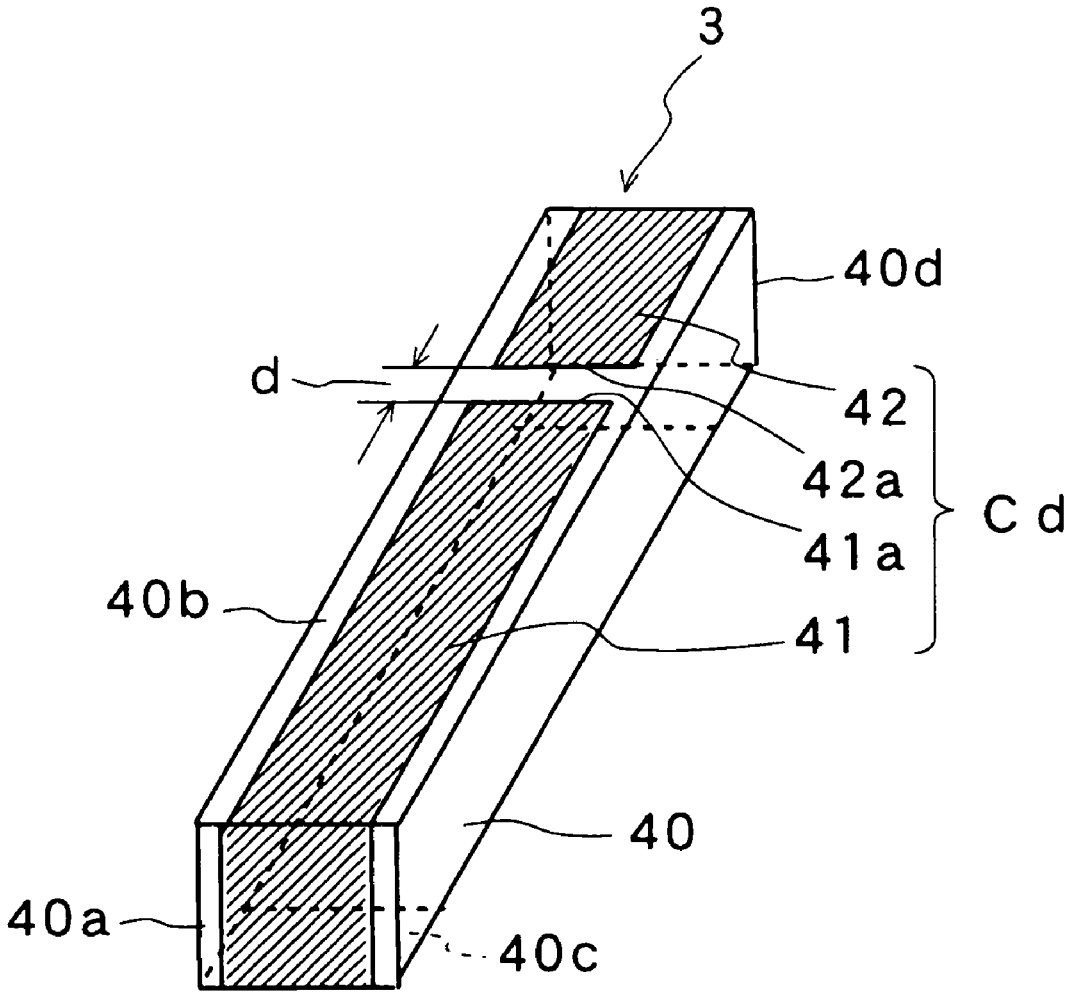
FIG. 3 is a magnified perspective view of a surface mount antenna component.
Figure 4:
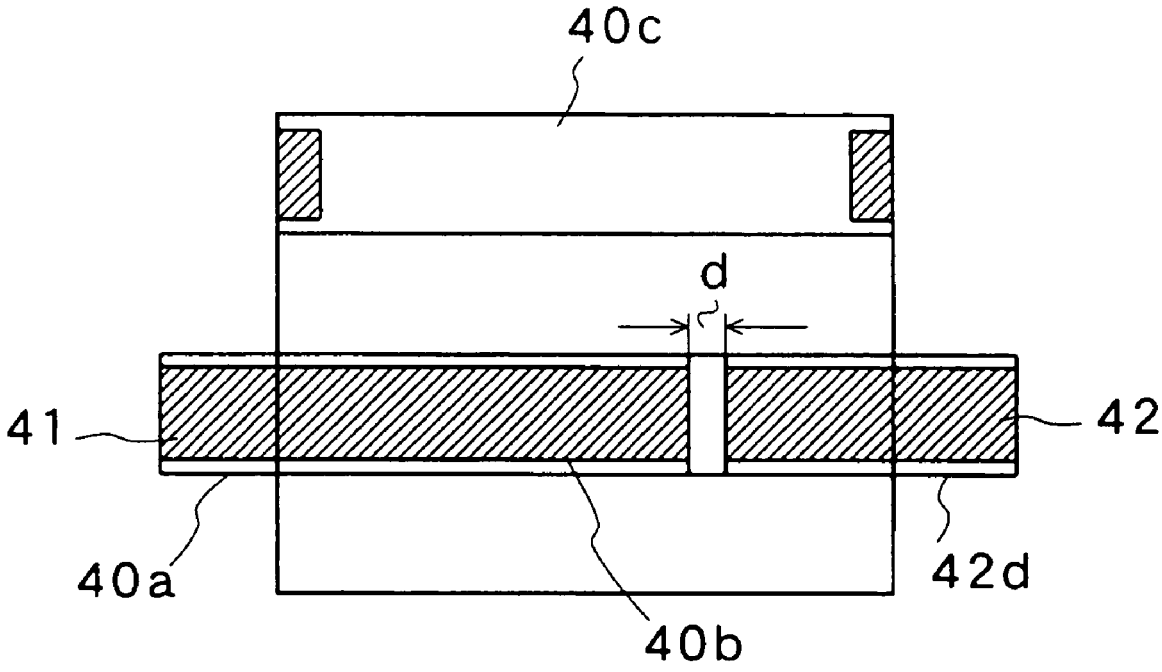
FIG. 4 is a plan view of the surface mount antenna component expanded along the peripheral surface thereof.
Figure 5:
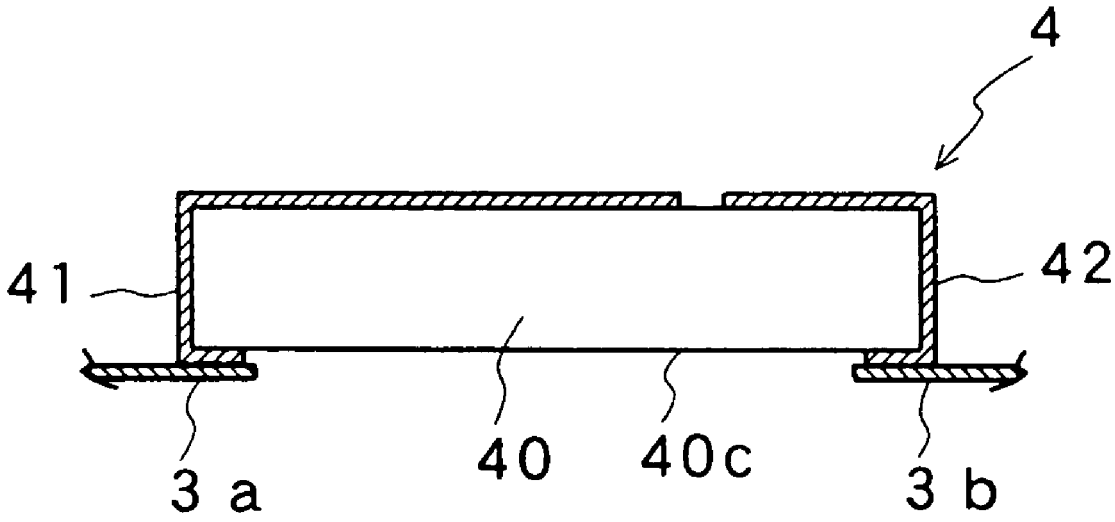
FIG. 5 is a side view showing a connection state of the surface mount antenna component and a parallel radiation electrode pattern.
Figure 6:
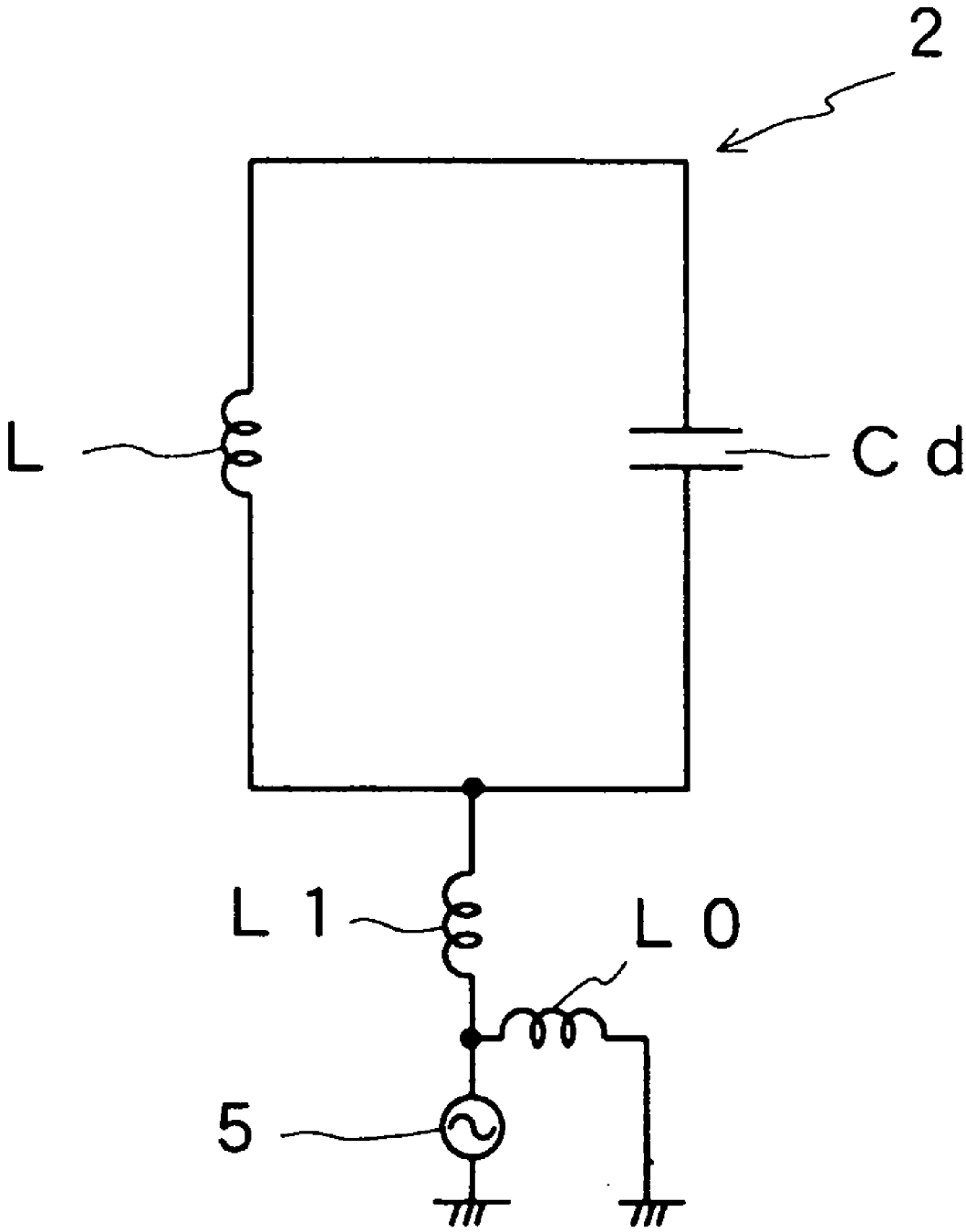
FIG. 6 is an equivalent circuit diagram briefly illustrating a parallel resonant circuit using lumped-constant elements.

FIG. 3 is a magnified perspective view of the surface mount antenna component 4. FIG. 4 is a plan view of the surface mount antenna component 4 that is expanded along the peripheral surface thereof. FIG. 5 is a side view showing a connection state of the surface mount antenna component 4 and the parallel radiation electrode pattern 3. FIG. 6 is an equivalent circuit diagram showing the parallel resonant circuit 2 using lumped-constant elements.

As shown in FIG. 3, the surface mount antenna component 4 includes a pair of electrodes 41 and 42. The pair of electrodes 41 and 42 is provided on a surface of a substantially rectangular substrate 40 preferably made of dielectric materials or other suitable material.

More specifically, as shown in FIGS. 3 and 4, the electrode 41 is arranged so as to cover a trailing end surface 40*a*, an upper surface 40*b*, and a lower surface 40*c* of the substrate 40, and the electrode 42 is arranged so as to cover a leading end surface 40*d*, the upper surface 40*b*, and the lower surface 40*c* of the substrate 40. An edge 41*a* of the electrode 41 surfaces an edge 42*a* of the electrode 42 with a distance d therebetween. With this arrangement, the pair of electrodes 41 and 42 define a capacitor Cd having a capacitance corresponding to the distance d. In addition, as shown in FIG. 5, the bottoms of the electrodes 41 and 42 on the lower surface 40*c* of the substrate 40 are soldered to ends 3*a* and 3*b*, respectively, of the parallel radiation electrode pattern 3.

As described above, the parallel radiation electrode pattern 3 that defines the inductor L is connected in parallel to the capacitor Cd of the surface mount antenna component 4, such that the parallel resonant circuit 2 including the inductor L and the capacitor Cd connected in parallel to each other are provided, as shown in FIG. 6.

The feed unit 5 supplies a high-frequency current to the parallel resonant circuit 2. In the first preferred embodiment, as shown in FIG. 1, a first inductor L1 is disposed between the feed unit 5 and the parallel resonant circuit 2.

More specifically, the first inductor L1 is preferably a lumped-constant coil used for impedance matching between the parallel resonant circuit 2 and the feed unit 5. One end of the first inductor L1 is connected to a feed electrode 2*a* of the parallel resonant circuit 2, and the other end of the first inductor L1 is soldered to the feed unit 5. An inductor L0 is also a matching coil. Together with the first inductor L1, the inductor L0 defines a matching circuit for the parallel resonant circuit 2 and the feed unit 5. Here, the first inductor L1 functions to increase the inductance of the parallel resonant circuit 2, as well as for impedance matching.

The operation and advantages of the antenna 1 according to the first preferred embodiment are described next.

Referring to FIG. 1, in the antenna 1, a high-frequency current supplied from the feed unit 5 to the feed electrode 2*a* of the parallel radiation electrode pattern 3 is transmitted to the parallel resonant circuit 2 via the first inductor L1, and the antenna 1 performs antenna operations in a basic mode and an upper mode in accordance with the high-frequency current. In the first preferred embodiment, with respect to the antenna 1, an improvement in the antenna efficiency, an increase in the bandwidth in each mode, and superior multiband performance are achieved.

In other words, since the parallel radiation electrode pattern 3 is arranged in a loop so as to occupy the majority of the non-ground region 201*a*, even if the size of the whole antenna 1 is reduced, the size of the parallel resonant circuit 2 is increased as compared to known technologies in which a surface mount antenna including the majority of the circuit is installed in a non-ground region. In other words, by providing the high-density parallel resonant circuit 2 in the small non-ground region 201*a*, miniaturization is achieved as compared to known technologies.

In addition, since the parallel resonant circuit 2 includes the long parallel radiation electrode pattern 3, the radiation resistance of the parallel resonant circuit 2 is increased by the parallel radiation electrode pattern 3. The radiation power from the parallel resonant circuit 2 increases as the radiation resistance increases. The antenna efficiency corresponds to the ratio of the radiation power to the feed power. Thus, by providing the long parallel radiation electrode pattern 3, the antenna efficiency is improved.

Furthermore, a Q factor in each mode changes depending on the radiation resistance. In accordance with an increase in the radiation resistance, a Q factor in each mode is reduced, and the bandwidth in each mode is increased.

In addition, as described above, since the parallel resonant circuit 2 is relatively large, an unwanted capacitance does not occur in the parallel resonant circuit 2. Thus, a margin that is large enough for adjusting the distance d between the pair of electrodes 41 and 42 that defines the capacitor Cd of the surface mount antenna component 4 is provided. As a result, the distance d between the pair of electrodes 41 and 42 can be freely adjusted to change the capacitance of the capacitor Cd. Thus, the resonant frequency in each mode can be reduced to a predetermined value, and superior multiband transmission and reception can be achieved. Multiband performance due to adjustment of the capacitance of the capacitor Cd will be described.

Figure 7A:
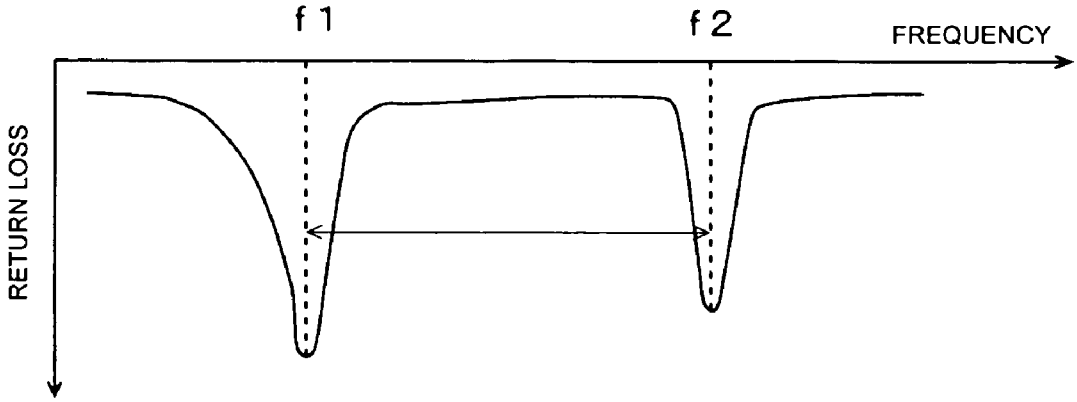
FIGS. 7A to 7C are diagrams showing a change in the frequency characteristics of the antenna in accordance with a change in the capacitance of a capacitor.
Figure 7B:
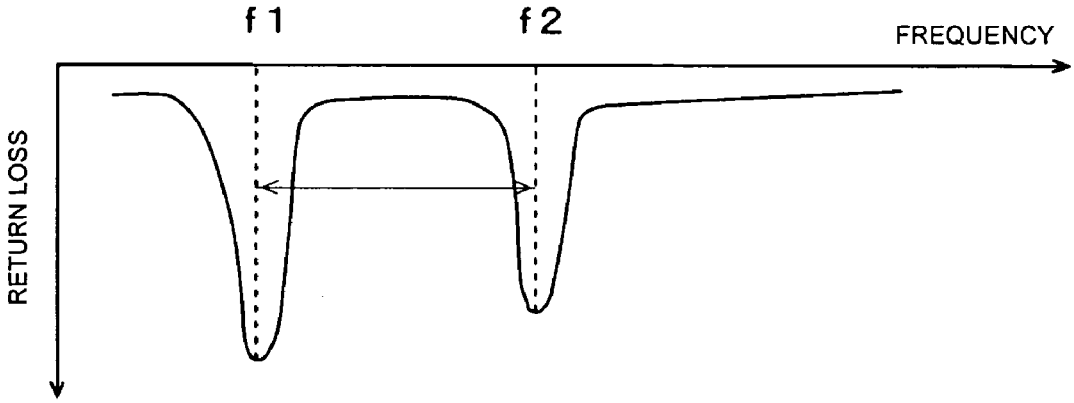
Figure 7C:
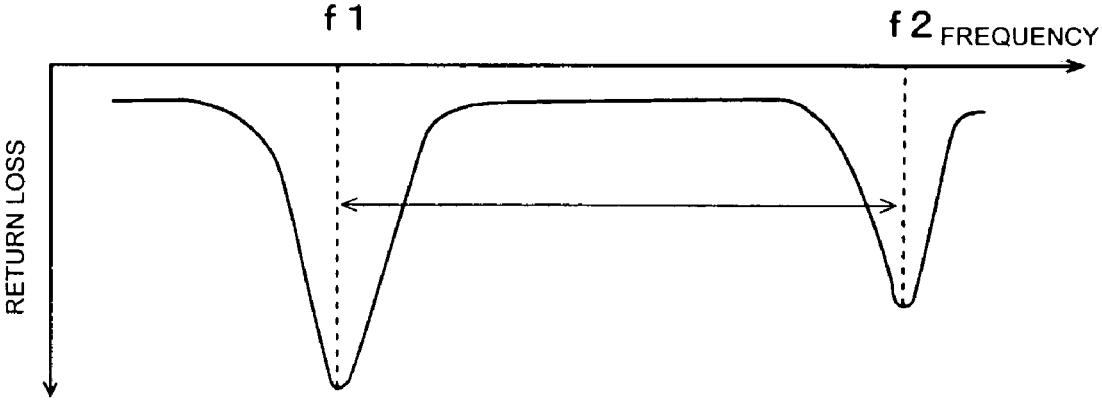

FIGS. 7A to 7C are diagrams showing a change in the frequency characteristics of the antenna 1 in accordance with a change in the capacitance of the capacitor Cd.

For example, as compared to a situation in which the distance d between the pair of electrodes 41 and 42 of the surface mount antenna component 4 is adjusted so as to produce the frequency characteristics shown in FIG. 7A, if the distance d between the pair of electrodes 41 and 42 is reduced to increase the capacitance of the capacitor Cd, the distance between a resonant frequency f1 in the basic mode and a resonant frequency f2 in the higher mode of the parallel resonant circuit 2 is, as shown in FIG. 7B, less than the distance between the resonant frequency f1 in the basic mode and the resonant frequency f2 in the higher mode in the sate shown in FIG. 7A.

In contrast, if the distance d between the pair of electrodes 41 and 42 is increased to reduce the capacitance of the capacitor Cd, the distance between the resonant frequency f1 in the basic mode and the resonant frequency f2 in the higher mode is, as shown in FIG. 7C, greater than the state shown in FIG. 7A.

As described above, since the capacitance of the capacitor Cd is adjusted to change the resonant frequency f2 in the higher mode and the resonant frequency f1 in the basic mode substantially independently of each other, it is easy to design both the resonant frequency f1 in the basic mode and the resonant frequency f2 in the higher mode to provide the required frequencies. Thus, the parallel resonant circuit 2 can perform antenna operations in the basic mode and the higher mode, such that electromagnetic waves can be transmitted and received using a plurality of required frequency bands.

Furthermore, since the long parallel radiation electrode pattern 3 is provided as the inductor L, a large inductance can be provided to the parallel resonant circuit 2. As a result, both the resonant frequencies f1 and f2 in the basic and higher modes can be significantly reduced.

As described above, according to the first preferred embodiment, the compact antenna 1 that achieves superior multi-band performance with an improved antenna efficiency and a wider bandwidth can be provided. In addition, the use of the radio communication apparatus 200 including the antenna 1 enables multiband communication with a reduced size, improved antenna efficiency, and a wider bandwidth.

Second Preferred Embodiment

A second preferred embodiment of the present invention is described next.

Figure 8:
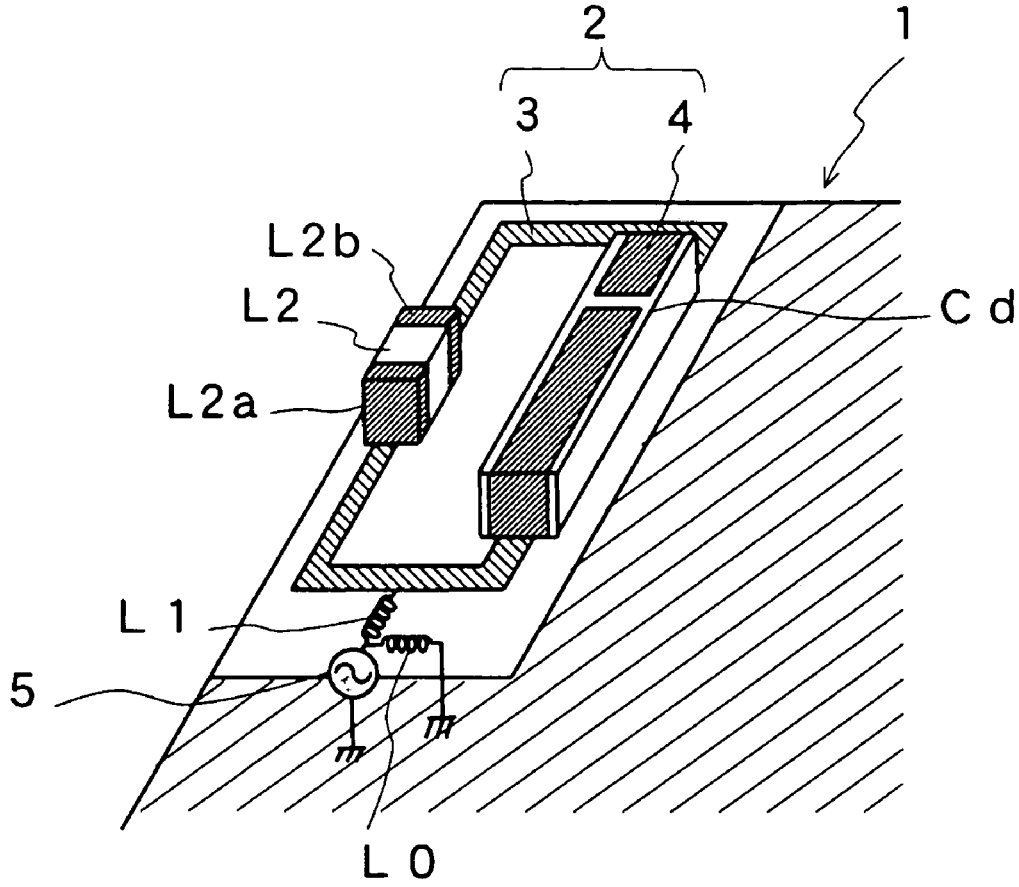
FIG. 8 is a perspective view of an antenna according to a second preferred embodiment of the present invention.
Figure 9:
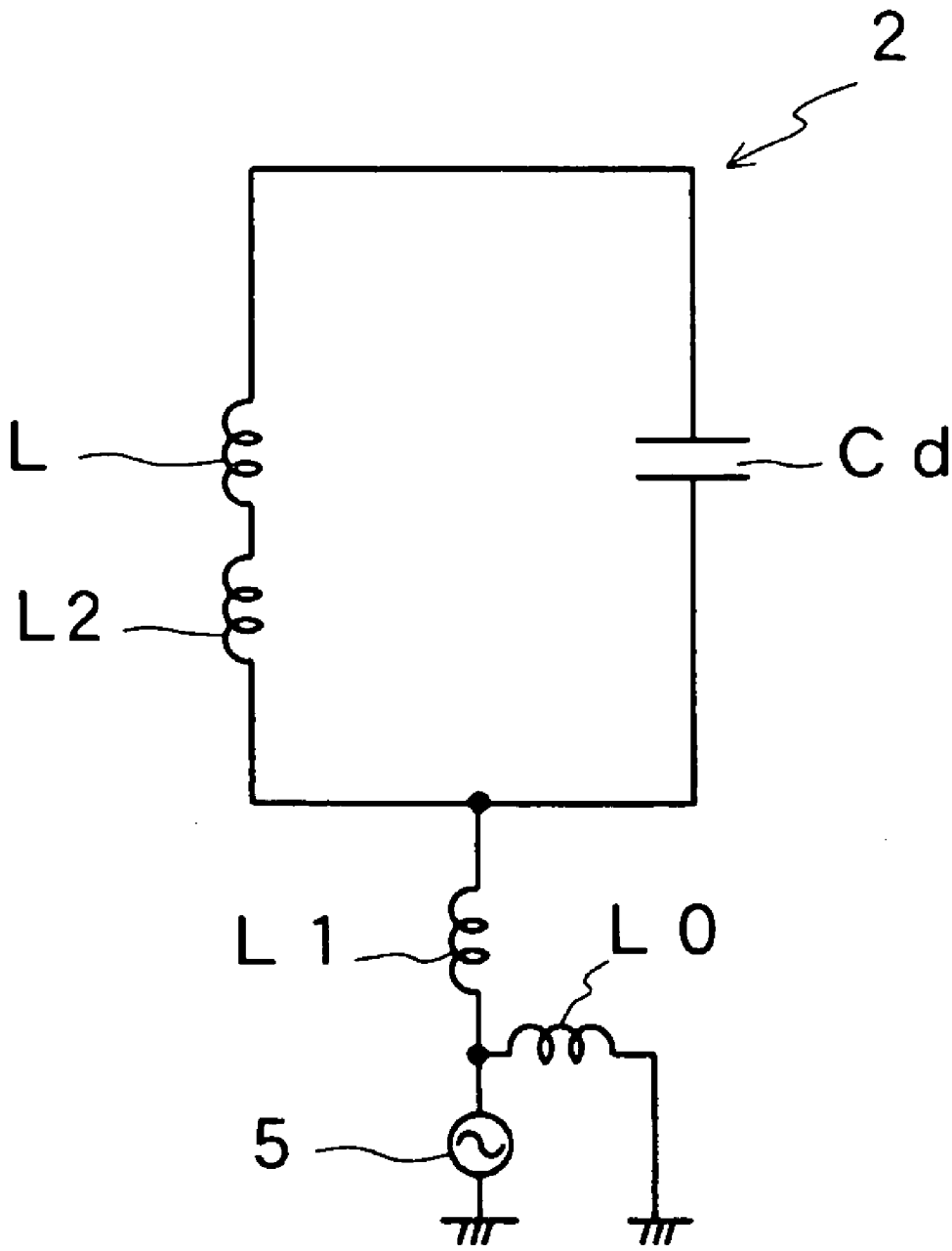
FIG. 9 is an equivalent circuit diagram briefly illustrating a parallel resonant circuit using lumped-constant elements.

FIG. 8 is a perspective view of an antenna according to the second preferred embodiment. FIG. 9 is an equivalent circuit diagram briefly illustrating the parallel resonant circuit 2 using lumped-constant elements.

The antenna 1 according to the second preferred embodiment is different from the antenna 1 according to the first preferred embodiment in that a second lumped-constant inductor L2 is disposed in the parallel radiation electrode pattern 3, for example, as shown in FIG. 8, in the middle of the parallel radiation electrode pattern 3.

As shown in FIG. 8, the second inductor L2 is a chip-type coil. The parallel radiation electrode pattern 3 is cut to be open in the middle thereof, and electrodes L2*a* and L2*b* of the second inductor L2 are soldered to cut ends of the parallel radiation electrode pattern 3 (below the second inductor L2).

With this structure, as shown in FIG. 9, the inductance of the parallel resonant circuit 2 increases by the inductance of the second inductor L2.

As a result, a lower frequency band can be obtained in the basic mode and the higher mode. In addition, since the length of the parallel radiation electrode pattern 3 is reduced and the inductance of the parallel resonant circuit 2 is increased, the size of the antenna 1 can be further reduced.

The other structures, operations, and advantages in the second preferred embodiment are similar to those in the first preferred embodiment. Thus, the descriptions thereof are omitted.

Third Preferred Embodiment

A third preferred embodiment of the present invention is described next.

Figure 10:
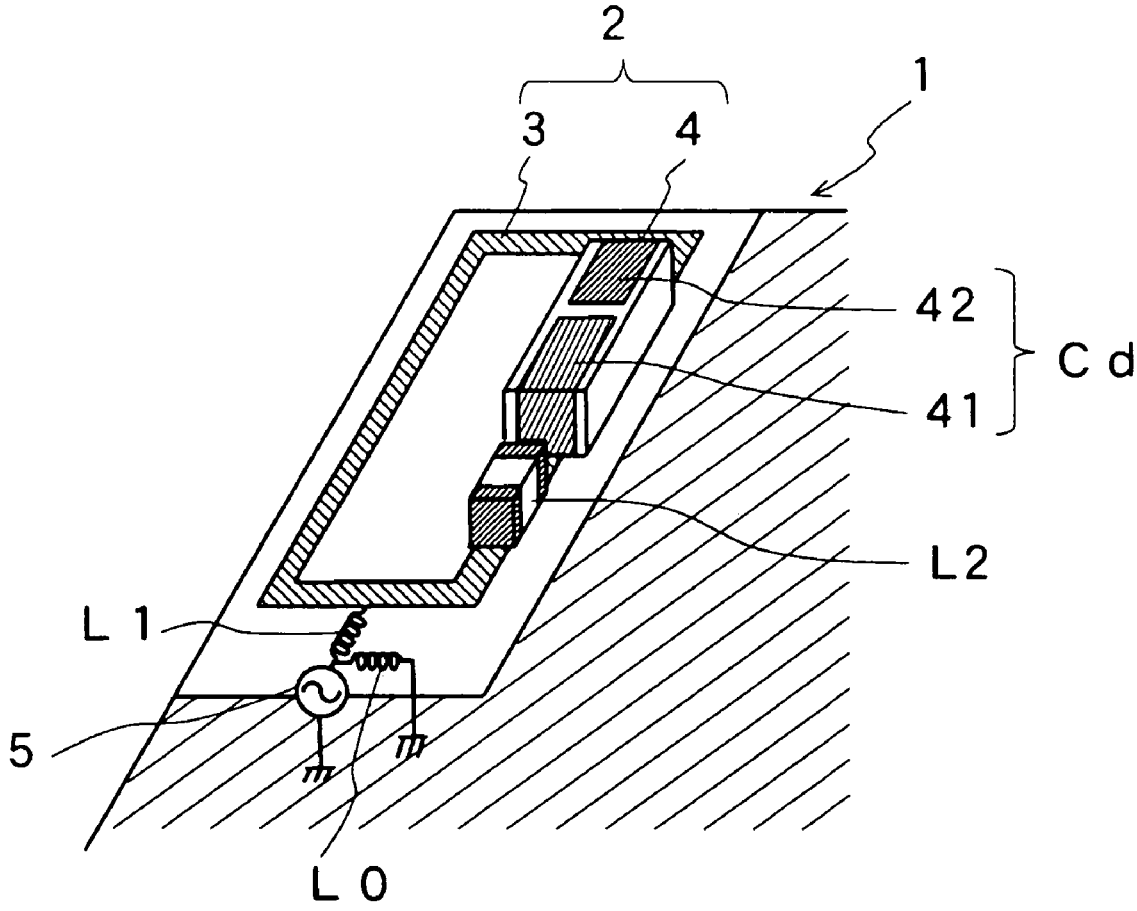
FIG. 10 is a perspective view of an antenna according to a third preferred embodiment of the present invention.
Figure 11:
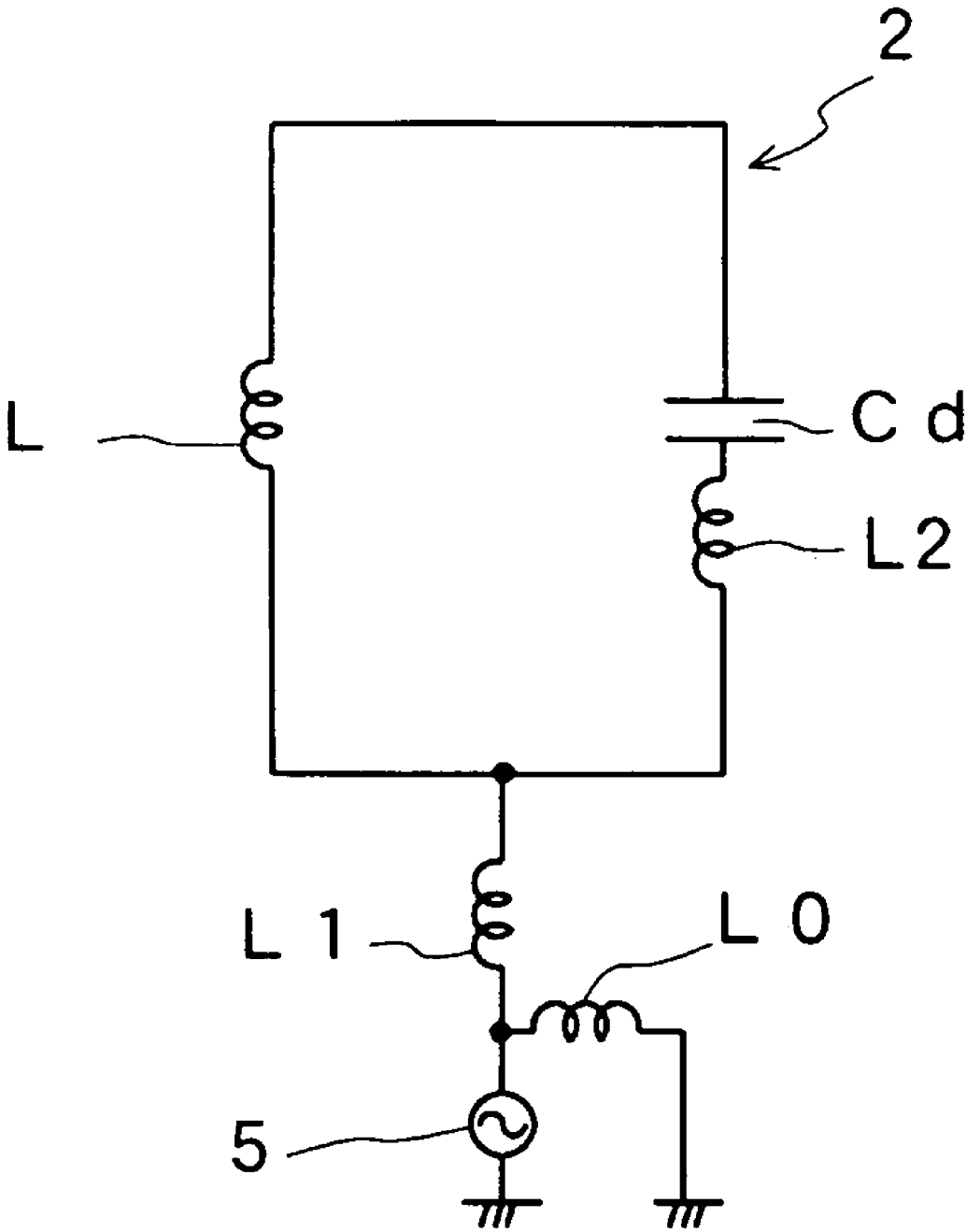
FIG. 11 is an equivalent circuit diagram briefly illustrating a parallel resonant circuit using lumped-constant elements.

FIG. 10 is a perspective view of an antenna according to a third preferred embodiment of the present invention. FIG. 11 is an equivalent circuit diagram briefly illustrating the parallel resonant circuit 2 using lumped-constant elements.

The antenna 1 according to the third preferred embodiment is different from the antenna 1 according to the first preferred embodiment in that the second lumped-constant inductor L2 is disposed near a connection portion of the parallel radiation electrode pattern 3 and the surface mount antenna component 4.

In other words, as shown in FIG. 10, a portion of the parallel radiation electrode pattern 3 that is connected to the electrode 41 of the surface mount antenna component 4 is cut to be open, and electrodes of the second inductor L2 are soldered to the cut ends of the parallel radiation electrode pattern 3.

With this structure, as shown in FIG. 11, a series circuit including the capacitor Cd and the second inductor L2 is arranged in the right portion of the parallel resonant circuit 2, and this series circuit and the inductor L of the parallel radiation electrode pattern 3 are connected in parallel to each other and constitute the parallel resonant circuit 2.

The other structures, operations, and advantages in the third preferred embodiment are similar to those in the first and second preferred embodiments. Thus, the descriptions thereof are omitted.

Fourth Preferred Embodiment

A fourth preferred embodiment of the present invention is described next.

Figure 12:
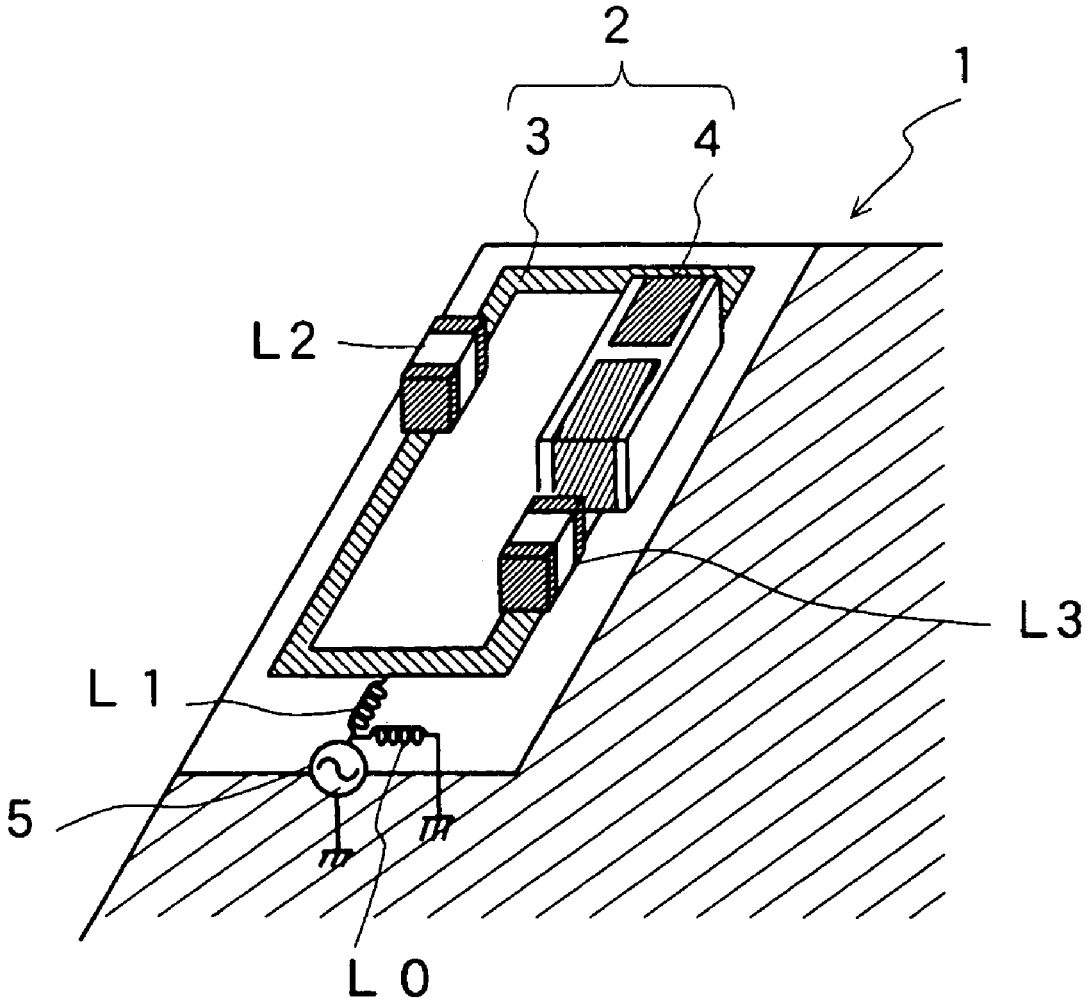
FIG. 12 is a perspective view of an antenna according to a fourth preferred embodiment of the present invention.
Figure 13:
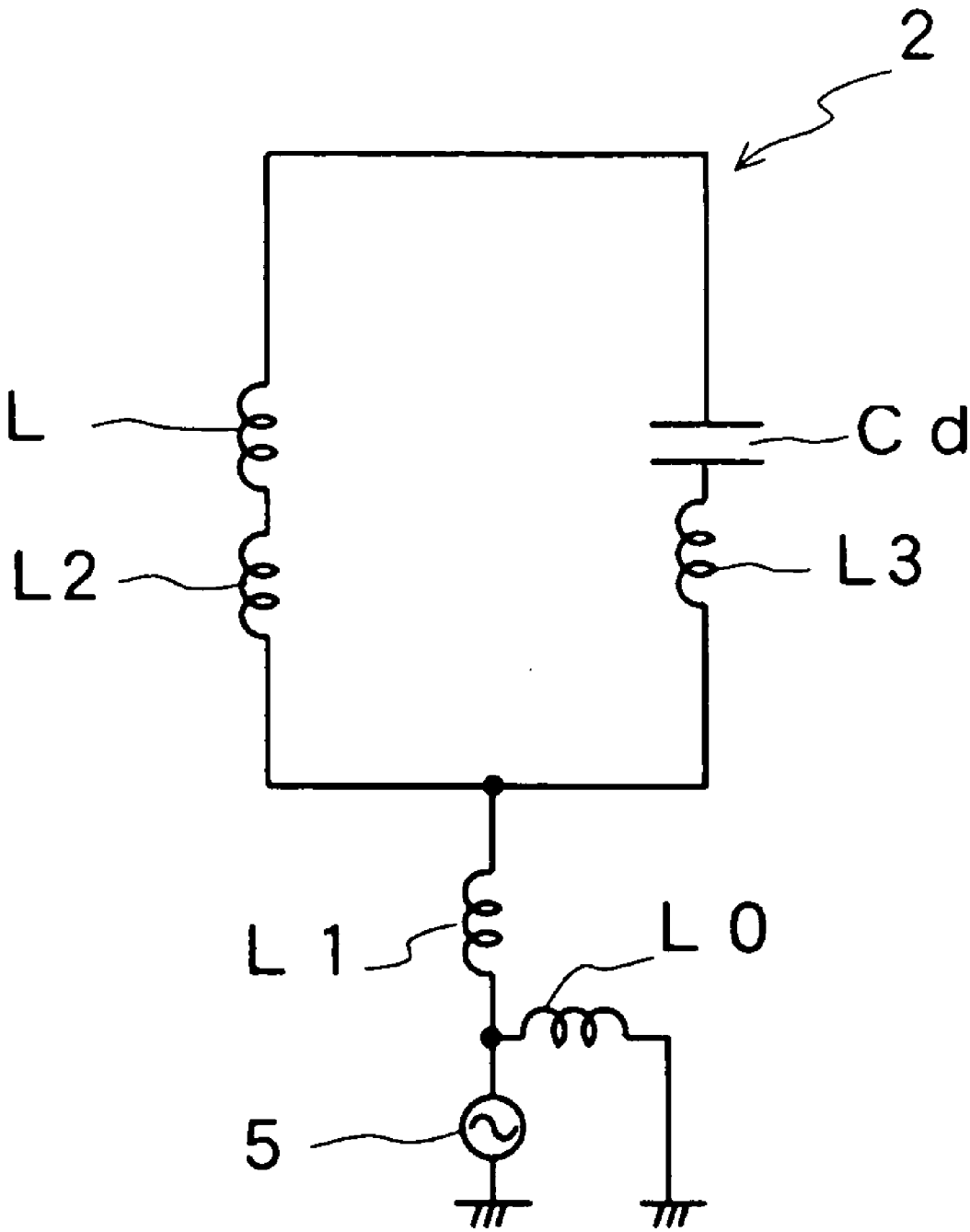
FIG. 13 is an equivalent circuit diagram briefly illustrating a parallel resonant circuit using lumped-constant elements.

FIG. 12 is a perspective view of an antenna according to the fourth preferred embodiment. FIG. 13 is an equivalent circuit diagram briefly illustrating the parallel resonant circuit 2 using lumped-constant elements.

In the antenna 1 according to the fourth preferred embodiment, the second lumped-constant inductor L2 is disposed in the middle of the parallel radiation electrode pattern 3 and a third lumped-constant inductor L3 is disposed near a connection portion of the parallel radiation electrode pattern 3 and the surface mount antenna component 4.

In other words, as shown in FIG. 13, a series circuit including the inductor L of the parallel radiation electrode pattern 3 and the second inductor L2 is arranged in the left portion of the parallel resonant circuit 2 and a series circuit including the capacitor Cd and the third inductor L3 is arranged in the right portion of the parallel resonant circuit 2. These series circuits are connected in parallel to each other and constitute the parallel resonant circuit 2.

With this structure, the inductance of the parallel resonant circuit 2 is further increased.

The other structures, operations, and advantages in the fourth preferred embodiment are similar to those in the second and third preferred embodiments. Thus, the descriptions thereof are omitted.

Fifth Preferred Embodiment

A fifth preferred embodiment of the present invention is described next.

Figure 14:
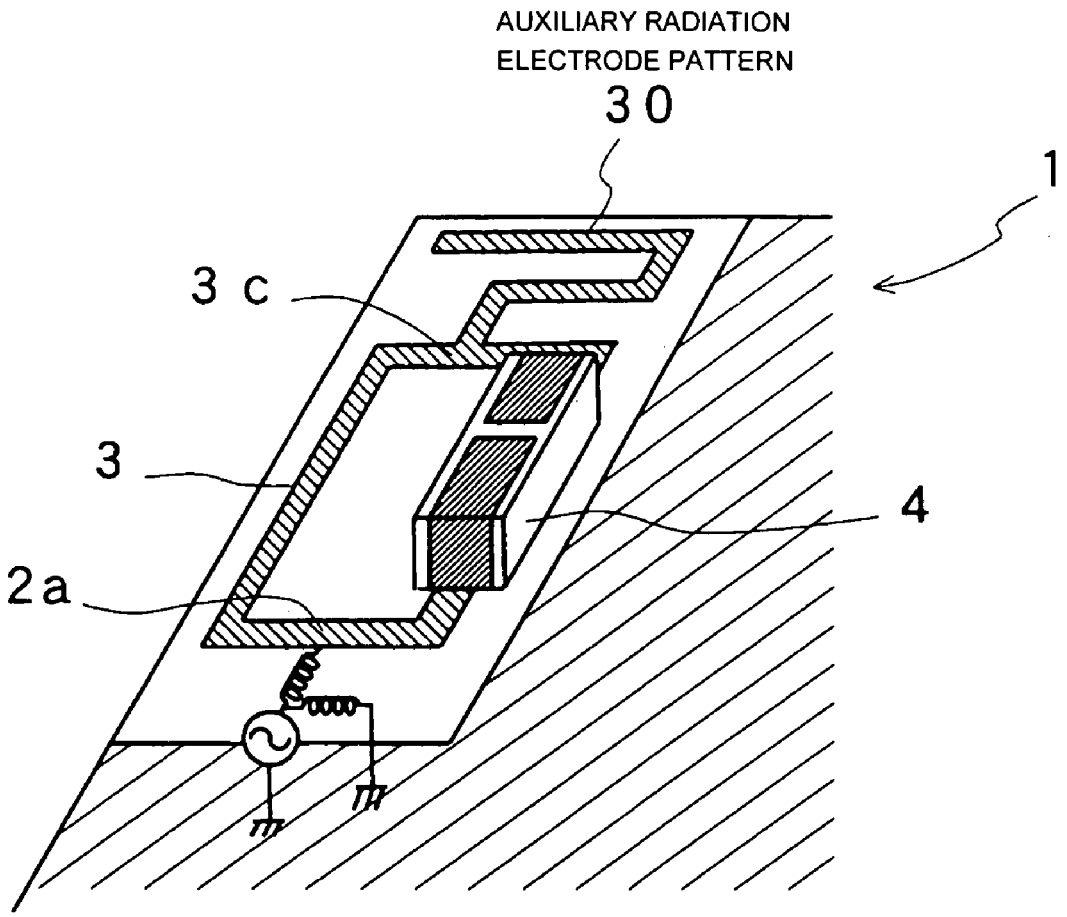
FIG. 14 is a perspective view of an antenna according to a fifth preferred embodiment of the present invention.

FIG. 14 is a perspective view of an antenna according to the fifth preferred embodiment.

As shown in FIG. 14, in the antenna 1 according to the fifth preferred embodiment, an auxiliary radiation electrode pattern 30 branches and extends from an end electrode, a portion of the parallel radiation electrode pattern 3 that is remote from the feed electrode 2*a*, another portion of the parallel radiation electrode pattern 3. More specifically, the size of the parallel radiation electrode pattern 3 arranged in a loop is reduced, and the auxiliary radiation electrode pattern 30 extends in a meandering shape from a portion 3*c* that is located substantially at an approximate center of the end electrode of the parallel radiation electrode pattern 3.

With this structure, since the radiation resistance is increased due to the auxiliary radiation electrode pattern 30, the antenna efficiency is improved by the increase in the radiation resistance. In addition, even in a narrow space above the mount board, the whole size of the antenna can be substantially increased, and sufficient antenna efficiency can be achieved.

The other structures, operations, and advantages in the fifth preferred embodiment are similar to those in the first embodiment. Thus, the descriptions thereof are omitted.

Sixth Preferred Embodiment

A sixth preferred embodiment of the present invention is described next.

Figure 15:
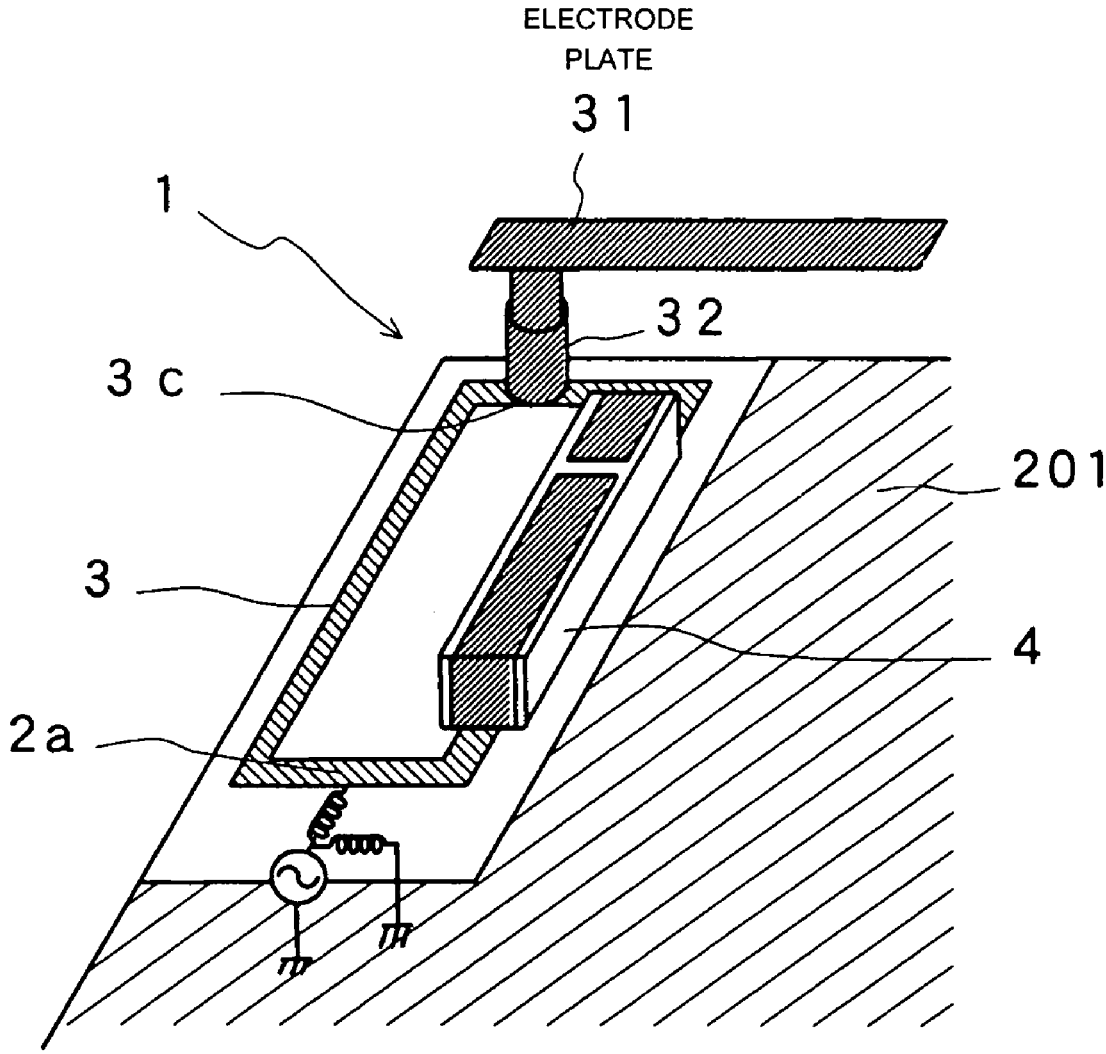
FIG. 15 is a perspective view of an antenna according to a sixth preferred embodiment of the present invention.

FIG. 15 is a perspective view of an antenna according to the sixth preferred embodiment.

As shown in FIG. 15, in the antenna 1 according to the sixth preferred embodiment, an electrode plate 31 that is substantially parallel to the mount board 201 is electrically connected above the end electrode of the parallel radiation electrode pattern 3 that is remote from the feed electrode 2*a*. More specifically, the parallel radiation electrode pattern 3 arranged in a loop is kept large, a support medium 32 is erected at the end electrode of the parallel radiation electrode pattern 3, and the electrode plate 31 is horizontally supported at an end of the support medium 32. A spring, which is not shown, is installed in the support medium 32 to urge the electrode plate 31 upwards. Thus, the electrode plate 31 is press-contacted with an inner surface of the case of the radio communication apparatus 200 (refer to FIG. 2).

With this structure, the total radiation area of the antenna 1 is increased, and the radiation resistance of the parallel resonant circuit 2 is increased. In accordance with this, the antenna efficiency is improved. In addition, even in a narrow space that is too narrow to have a sufficient width of the parallel radiation electrode pattern 3, the size of the whole antenna can be increased in the height direction.

The other structures, operations, and advantages in the sixth preferred embodiment are similar to those in the fifth preferred embodiment. Thus, the descriptions thereof are omitted.

Seventh Preferred Embodiment

A seventh preferred embodiment of the present invention is described next.

Figure 16:
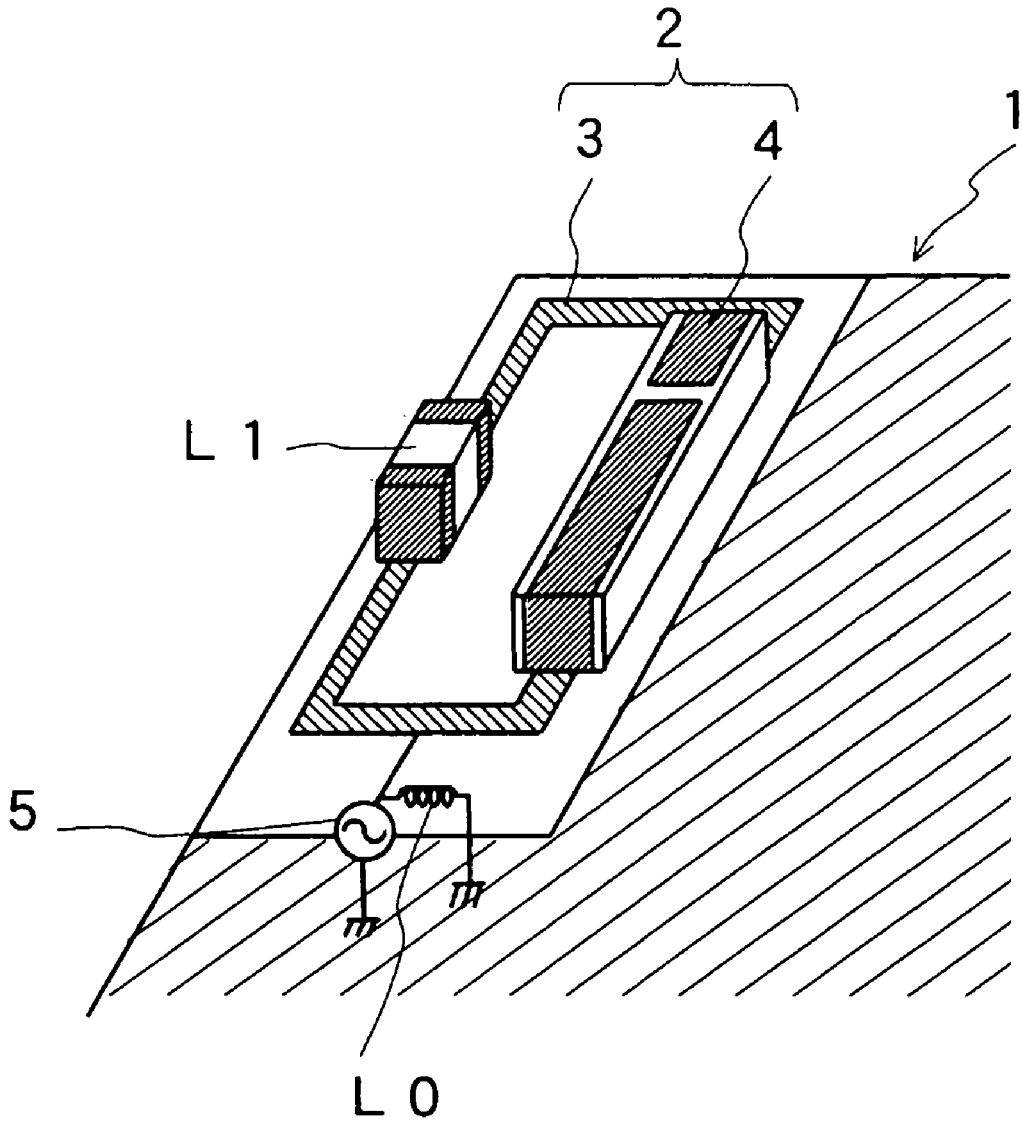
FIG. 16 is a perspective view of an antenna according to a seventh preferred embodiment of the present invention.
Figure 17:
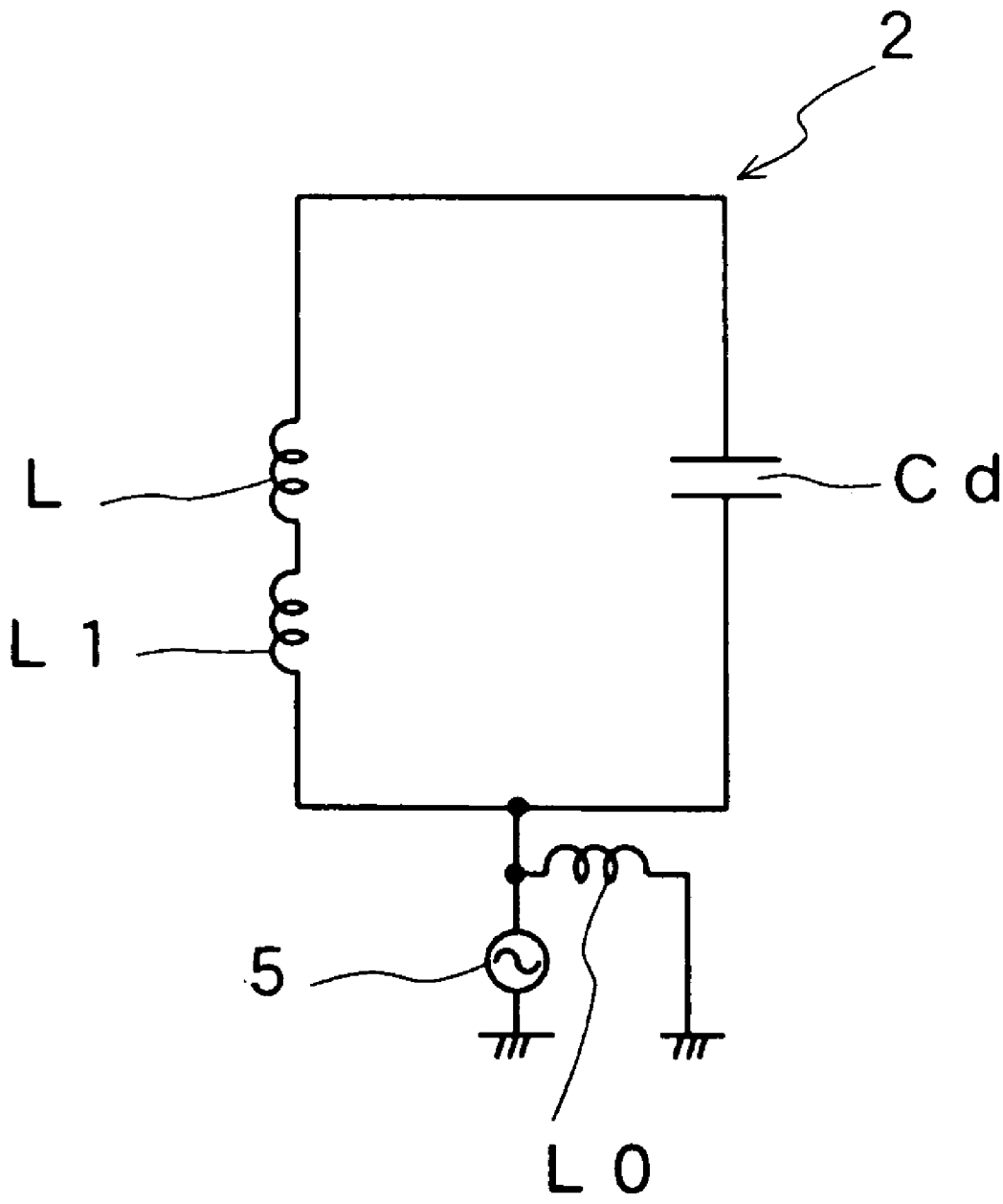
FIG. 17 is an equivalent circuit diagram briefly illustrating a parallel resonant circuit using lumped-constant elements.

FIG. 16 is a perspective view of an antenna according to the seventh preferred embodiment. FIG. 17 is an equivalent circuit diagram briefly illustrating the parallel resonant circuit 2 using lumped-constant elements.

The antenna 1 according to the seventh preferred embodiment is different from the antenna 1 according to the first preferred embodiment in that the first inductor L1 is disposed in the parallel radiation electrode pattern 3, for example, as shown in FIG. 16, in the middle of the parallel radiation electrode pattern 3.

With this structure, as shown in FIG. 17, the first inductor L1 increases the inductance of the parallel resonant circuit 2. The inductor L0 performs matching between the parallel resonant circuit 2 and the feed unit 5. The inductance of the first inductor L1 in the seventh preferred embodiment can be different from the inductance of the first inductor L1 in the first preferred embodiment when needed.

The other structures, operations, and advantages in the seventh preferred embodiment are similar to those in the first and second preferred embodiments. Thus, the descriptions thereof are omitted.

Eighth Preferred Embodiment

An eighth preferred embodiment of the present invention is described next.

Figure 18:
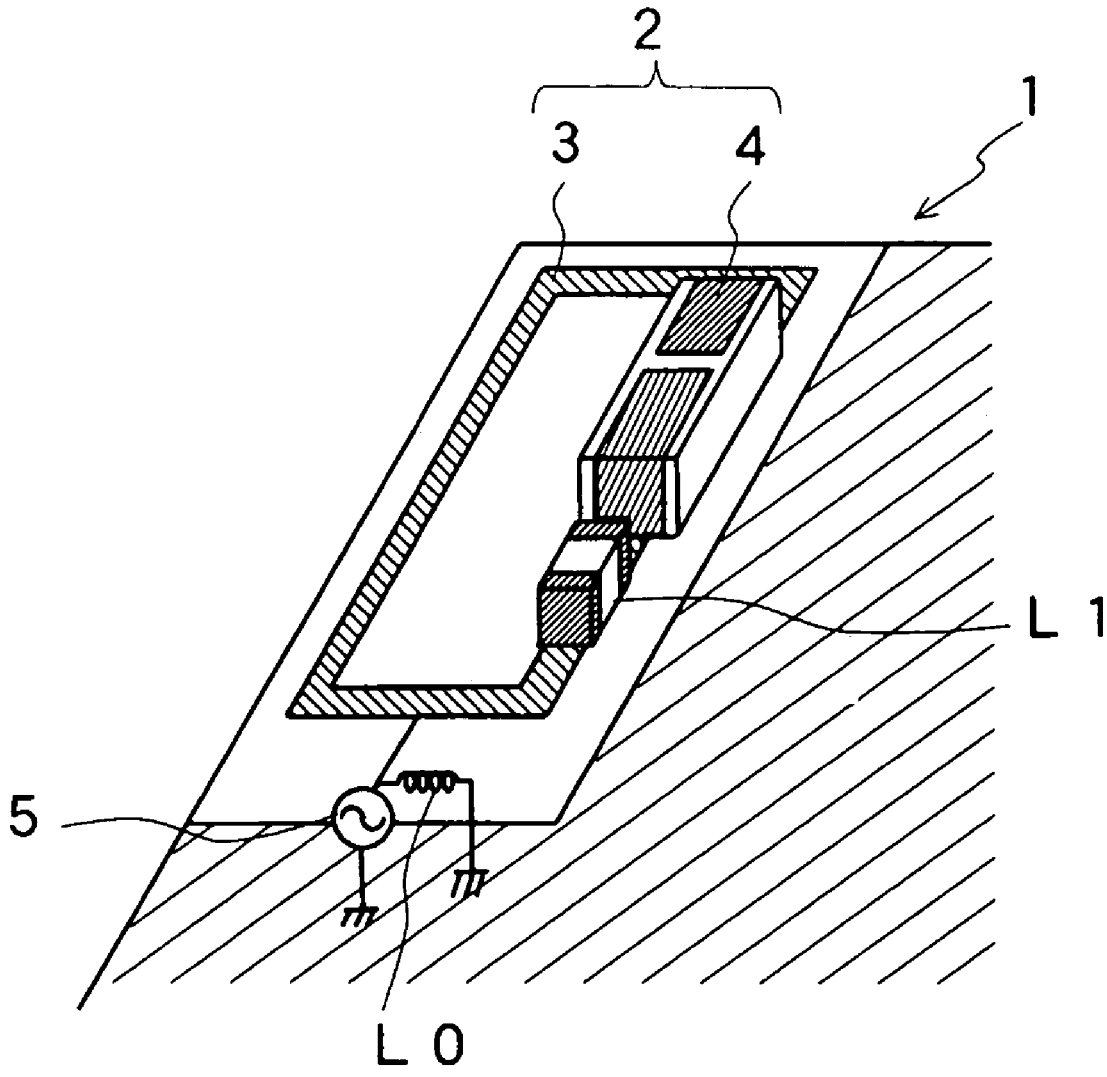
FIG. 18 is a perspective view of an antenna according to an eighth preferred embodiment of the present invention.
Figure 19:
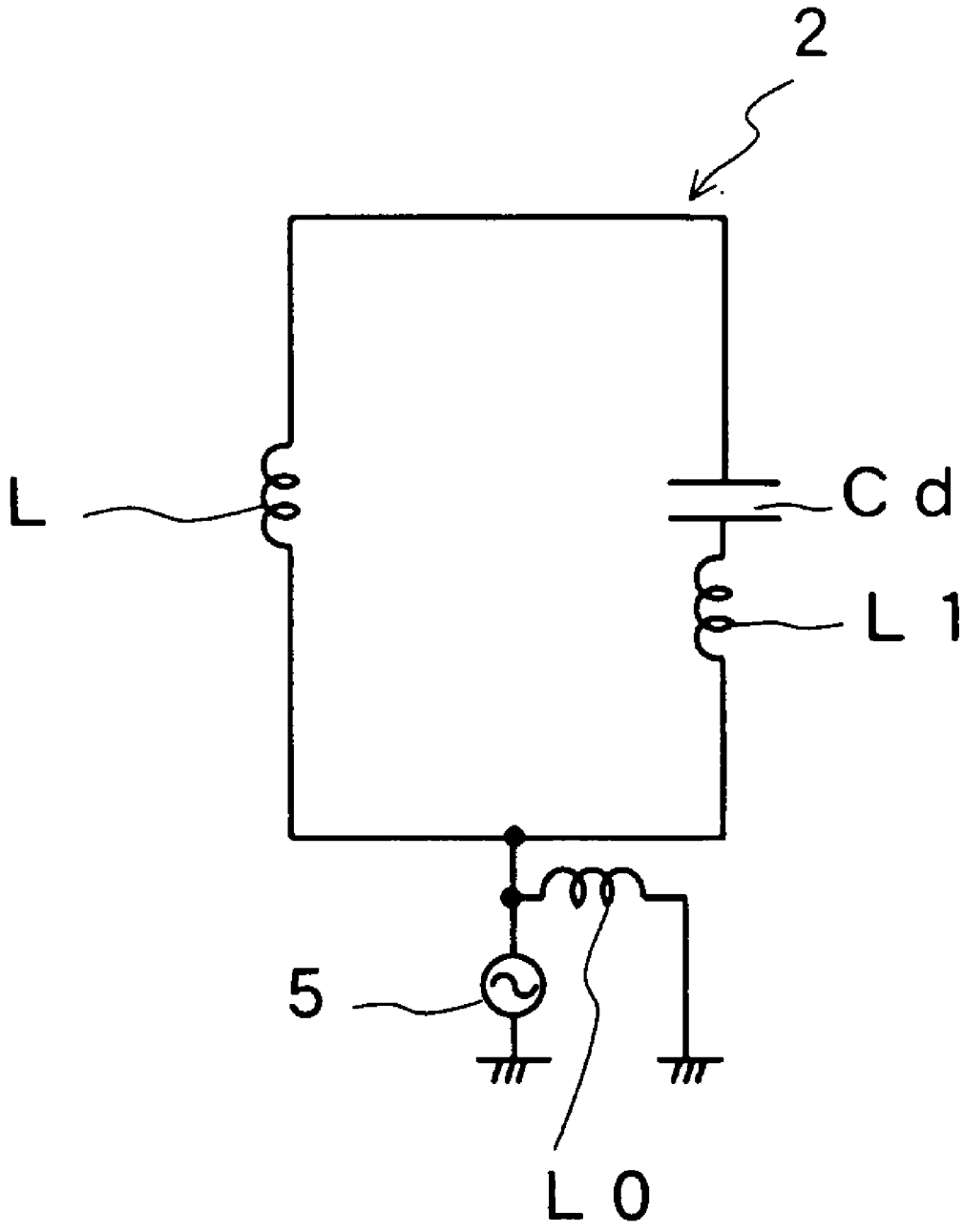
FIG. 19 is an equivalent circuit diagram briefly illustrating a parallel resonant circuit using lumped-constant elements.

FIG. 18 is a perspective view of an antenna according to the eighth preferred embodiment. FIG. 19 is an equivalent circuit diagram briefly illustrating the parallel resonant circuit 2 using lumped-constant elements.

The antenna 1 according to the eighth preferred embodiment is different from the antenna 1 according to the seventh preferred embodiment in that the first inductor L1 is disposed near a connection portion of the parallel radiation electrode pattern 3 and the surface mount antenna component 4, as shown in FIG. 18.

With this structure, as shown in FIG. 19, the first inductor L1 and the capacitor Cd constitute a series circuit, and this series circuit and the inductor L of the parallel radiation electrode pattern 3 are connected in parallel to each other and define the parallel resonant circuit 2.

The other structures, operations, and advantages in the eighth preferred embodiment are similar to the third and seventh preferred embodiments. Thus, the descriptions thereof are omitted.

Ninth Preferred Embodiment

A ninth preferred embodiment of the present invention is described next.

Figure 20:
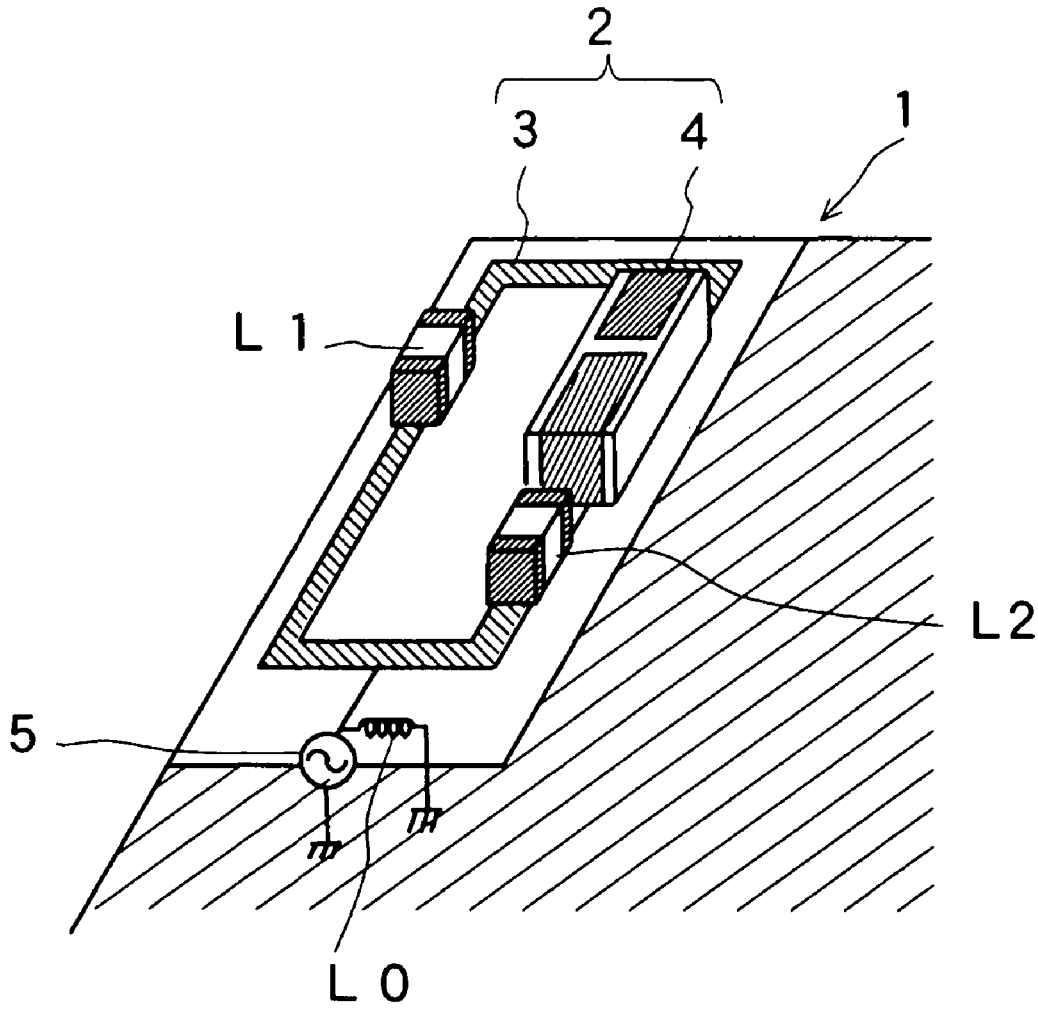
FIG. 20 is a perspective view of an antenna according to a ninth preferred embodiment of the present invention.
Figure 21:
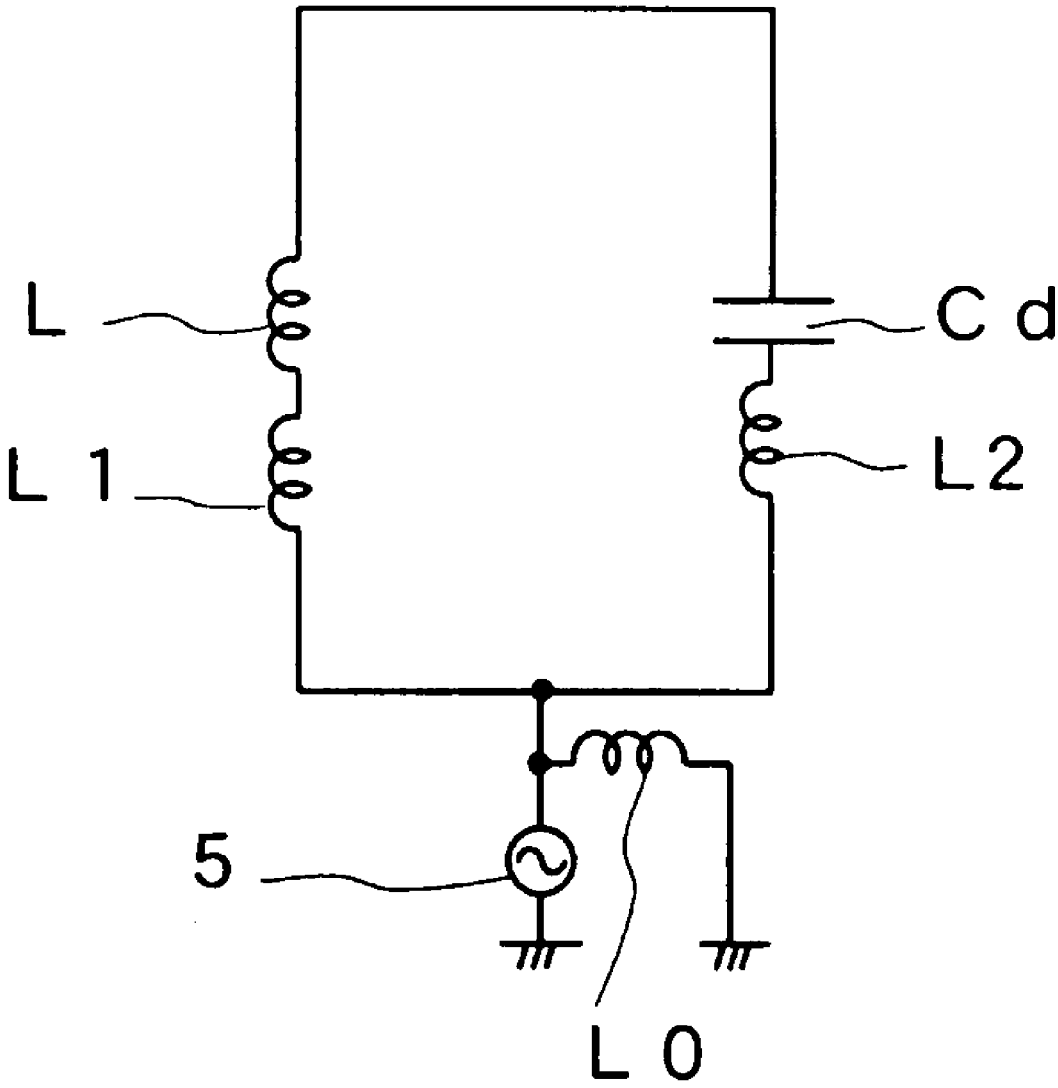
FIG. 21 is an equivalent circuit diagram briefly illustrating a parallel resonant circuit using lumped-constant elements.

FIG. 20 is a perspective view of an antenna according to the ninth preferred embodiment. FIG. 21 is an equivalent circuit diagram briefly illustrating the parallel resonant circuit 2 using lumped-constant elements.

As shown in FIG. 20, in the antenna 1 according to the ninth preferred embodiment, the first lumped-constant inductor L1 is disposed in the parallel radiation electrode pattern 3, for example, in the middle of the parallel radiation electrode pattern 3, and the second lumped-constant inductor L2 is disposed near a connection portion of the parallel radiation electrode pattern 3 and the surface mount antenna component 4.

In other words, as shown in FIG. 21, the inductor L of the parallel radiation electrode pattern 3 and the first inductor L1 constitute a series circuit, the second inductor L2 and the capacitor Cd constitute a series circuit, and these series circuits are connected in parallel to each other and constitute the parallel resonant circuit 2.

With this structure, the inductance of the parallel resonant circuit 2 significantly increases.

The other structures, operations, and advantages in the ninth preferred embodiment are similar to those in the fourth, seventh, and eighth preferred embodiments. Thus, the descriptions thereof are omitted.

Tenth Preferred Embodiment

A tenth preferred embodiment of the present invention is described next.

Figure 22:
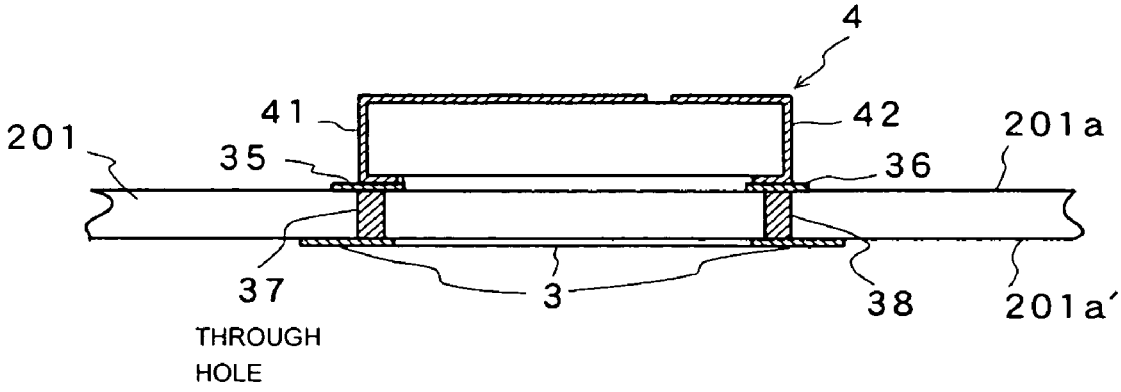
FIG. 22 is a sectional view of an antenna according to a tenth preferred embodiment of the present invention.
Figure 23:
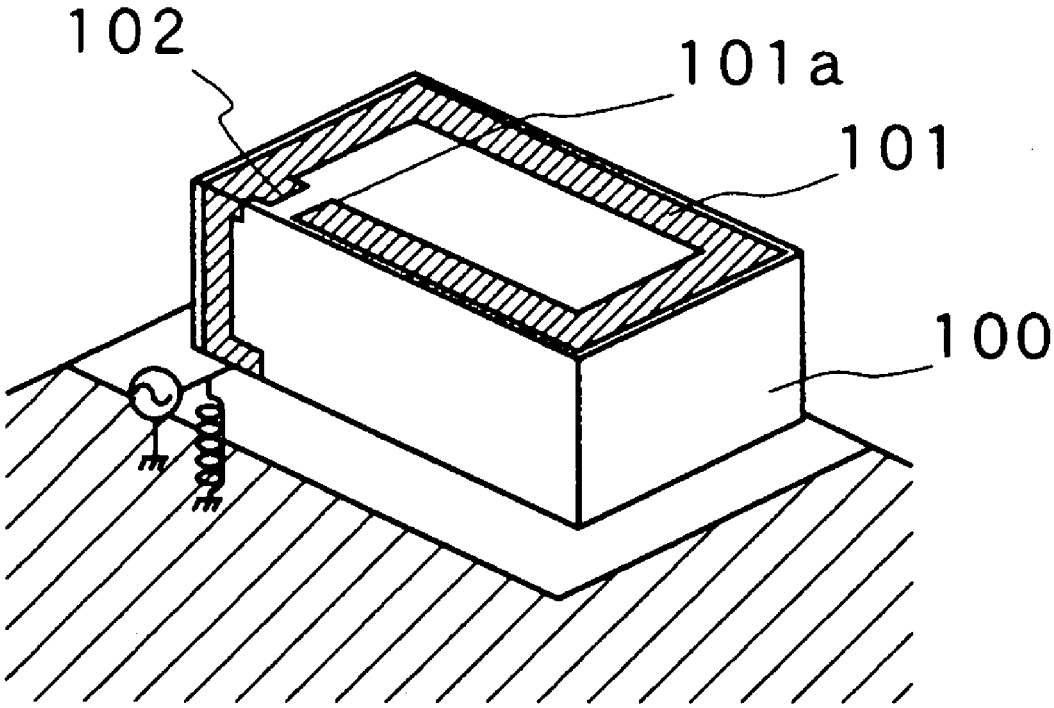
FIG. 23 PRIOR ART
FIG. 23 is a perspective view of a dual band antenna according to a known example.
Figure 24:
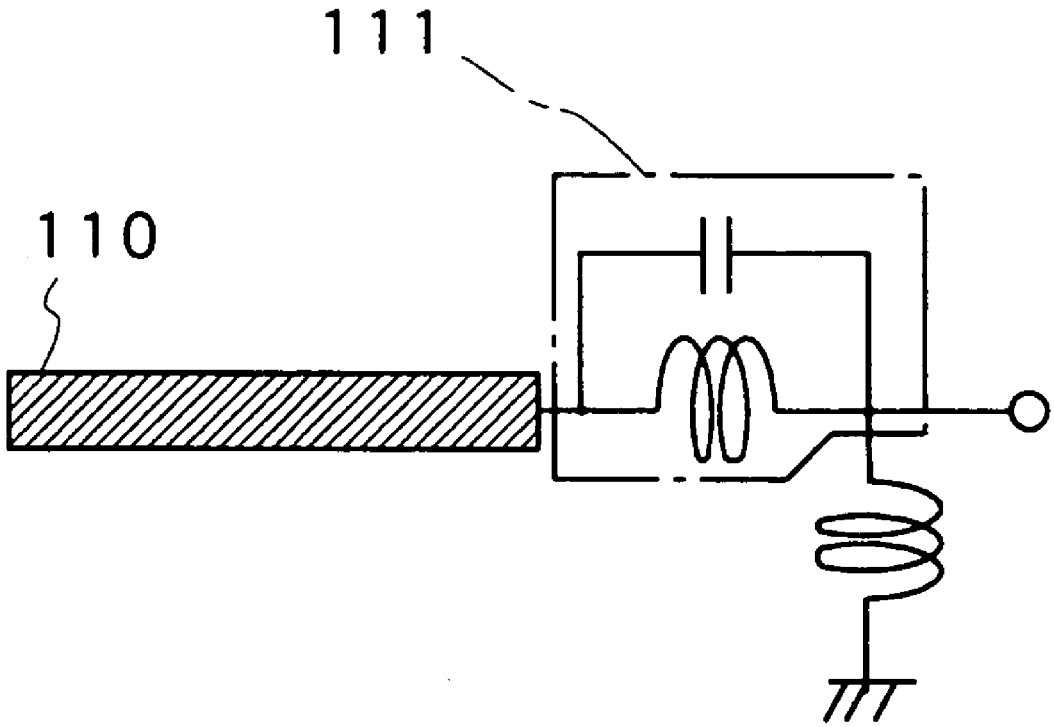
FIG. 24 PRIOR ART
FIG. 24 is a circuit diagram showing a dual band antenna according to another known example.

FIG. 22 is a sectional view of an antenna according to the tenth preferred embodiment.

As shown in FIG. 22, in the antenna according to the tenth preferred embodiment, the surface mount antenna component 4 is installed on lands 35 and 36 provided in the non-ground region 201*a* on a upper surface of the mount board 201 and the parallel radiation electrode pattern 3 is provided in a non-ground region 201*a*' on a lower surface of the mount board 201. The parallel radiation electrode pattern 3 on the lower surface is connected to the lands 35 and 36 on the upper surface via through holes 37 and 38, and the parallel radiation electrode pattern 3 and the surface mount antenna component 4 are connected in parallel to each other and constitute the parallel resonant circuit 2.

With this structure, the area occupied by the parallel resonant circuit 2 is reduced. Thus, the size of the antenna 1 can be further reduced.

The other structures, operations, and advantages in the tenth preferred embodiment are similar to those in the first to ninth preferred embodiments. Thus, the descriptions thereof are omitted.

The present invention is not limited to the foregoing preferred embodiments. Various changes and modifications can be made to the present invention without departing from the spirit and the scope thereof.

For example, although an example in which adjusting the distance d between the pair of electrodes 41 and 42 of the surface mount antenna component 4 controls the capacitance of the capacitor Cd has been described in the foregoing preferred embodiments, it is obvious that adjusting the widths of the pair of electrodes 41 and 42 can also control the capacitance of the capacitor Cd.

In addition, although the auxiliary radiation electrode pattern 30 preferably has a meandering shape in the fifth preferred embodiment and the electrode plate 31 preferably has a substantially rectangular shape in the sixth preferred embodiment, the shapes of the auxiliary radiation electrode pattern 30 and the electrode plate 31 are not limited to these shapes. The auxiliary radiation electrode pattern 30 and the electrode plate 31 can be arranged to have any shape.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention that fall within the true spirit and scope of the invention.

What is claimed is:

1. An antenna comprising:

a mount board having a non-ground region;

a parallel resonant circuit provided in the non-ground region, the parallel resonant circuit including a surface mount antenna component including a substrate and at least a pair of electrodes arranged on a surface of the substrate so as to face each other with a predetermined distance therebetween to define a capacitor, and a parallel radiation electrode pattern having an inductor and a feed electrode, the parallel radiation electrode pattern being connected in parallel to the capacitor; and a first lumped-constant inductor connected to or included in the parallel resonant circuit.

2. The antenna according to claim 1, wherein the first lumped-constant inductor is disposed between the feed electrode of the parallel resonant circuit and a feed unit to which the antenna is to be connected, thereby the first lumped-constant inductor is connected to the parallel resonant circuit.

3. The antenna according to claim 2, further comprising a second lumped-constant inductor disposed in the parallel radiation electrode pattern.

4. The antenna according to claim 2, further comprising a second lumped-constant inductor disposed near a connection portion of the surface mount antenna component and the parallel radiation electrode pattern.

5. The antenna according to claim 2, further comprising:

a second lumped-constant inductor disposed in the parallel radiation electrode pattern; and a third lumped-constant inductor disposed near a connection portion of the surface mount antenna component and the parallel radiation electrode pattern.

6. The antenna according to claim 1, wherein the first lumped-constant inductor is disposed in the parallel radiation electrode pattern, thereby the first lumped-constant inductor is included in the parallel resonant circuit.

7. The antenna according to claim 1, wherein the first lumped-constant inductor is disposed near a connection portion of the surface mount antenna component and the parallel radiation electrode pattern.

8. The antenna according to claim 1, further comprising:

a second lumped-constant inductor disposed near a connection portion of the surface mount antenna component and the parallel radiation electrode pattern, wherein the first lumped-constant inductor is disposed in the parallel radiation electrode pattern.

9. The antenna according to claim 1, wherein the parallel resonant circuit further includes an auxiliary radiation electrode pattern that branches and extends from an end of the parallel radiation electrode pattern that is remote from the feed electrode.

10. The antenna according to claim 1, wherein the parallel resonant circuit further includes an electrode plate that is substantially parallel to the mount board, the electrode plate being electrically connected above an end of the parallel radiation electrode pattern that is remote from the feed electrode.

11. The antenna according to claim 1, wherein:

the parallel radiation electrode pattern is provided in a non-ground region on a back surface of the mount board; and the parallel radiation electrode pattern is connected in parallel to the surface mount antenna component via a through hole.

12. A radio communication apparatus comprising the antenna as set forth in claim 1.

* * * * *